United States Patent [19]

Reeve

[11] 3,950,217

[45] Apr. 13, 1976

[54] REMOVAL OF SODIUM CHLORIDE FROM PULPING OPERATIONS

[75] Inventor: Douglas W. Reeve, Orton, Canada

[73] Assignee: ERCO Envirotech Ltd., Islington, Canada

[22] Filed: Dec. 12, 1973

[21] Appl. No.: 423,998

[30] Foreign Application Priority Data

| | | |
|---|---|---|
| Dec. 15, 1972 | United Kingdom | 58029/72 |
| Mar. 22, 1973 | United Kingdom | 13726/73 |
| May 31, 1973 | United Kingdom | 25985/73 |

[52] U.S. Cl. ..... 162/19; 162/30 K; 162/DIG.8; 423/207

[51] Int. Cl.[2] D21C 3/26; D21C 11/04; D21C 11/12

[58] Field of Search ..... 162/DIG. 8, 30, 17, 19; 423/207, 499

[56] References Cited

UNITED STATES PATENTS

| | | | |
|---|---|---|---|
| 3,698,995 | 10/1972 | Rapson | 162/19 |
| 3,746,612 | 7/1973 | Rapson et al. | 162/17 |

*Primary Examiner*—S. Leon Bashore
*Assistant Examiner*—Peter F. Kratz
*Attorney, Agent, or Firm*—Sim & McBurney

[57] ABSTRACT

In the recovery and regeneration of spent pulping chemicals from the production of cellulosic fibrous material pulp there is provided a white liquor containing dissolved quantities of sodium chloride and unregenerated pulping chemicals. The white liquor is concentrated by evaporation to deposit therefrom sodium chloride and unregenerated pulping chemicals, unregenerated pulping chemicals substantially free from sodium chloride are recovered from the deposited materials, and sodium chloride is separated and recovered from the deposited materials. The deposition of sodium chloride and unregenerated pulping chemicals is usually carried out in two stages, with unregenerated pulping chemicals substantially free from sodium chloride being deposited in the first stage. The sodium chloride then is deposited in the second stage, possibly in admixture with unregenerated pulping chemicals, in which event substantially pure sodium chloride is separated from the deposited mixture. At least part of the unregenerated pulping chemicals substantially free from sodium chloride are forwarded to the spend pulping liquor.

43 Claims, 5 Drawing Figures

REMOVAL OF SODIUM CHLORIDE FROM PULPING OPERATIONS

FIELD OF THE INVENTION

The present invention is directed to the removal of sodium chloride from pulping operations, more particularly from chemical wood pulping operations including bleaching procedures for the pulp, with enhanced efficiency of pulp mill operations.

BACKGROUND TO THE INVENTION

Generally in the production of pulp suitable for formation into paper, wood or other raw cellulosic fibrous material, is subjected to chemical digestion in a pulping liquor to form a pulp of the cellulosic fibrous material. The pulp thereafter is subjected to brightening and purification operations in a bleach plant.

The spent pulping liquor usually is subjected to a series of recovery and regeneration operations to recover pulping chemicals and to provide fresh pulping liquor. Generally, the pulping liquor contains sodium hydroxide and other sodium salts.

A widely used pulping process is the Kraft process. While the present invention will be described hereinafter with particular reference to Kraft mills, the process is applicable also to other pulp mill operations involving the use of sodium hydroxide as pulping chemical and which utilize spent chemical recovery and pulping chemical regeneration operations. Many such operations involve the use of sulphur-containing chemicals in addition to the alkali metal hydroxide, including the Kraft process, high yield pretreatment Kraft process and other processes. Other pulping operations which may be employed include the soda process and the soda-oxygen process. The present invention also is applicable to cross-recovery operation used in mixed systems.

In the conventional Kraft process, raw cellulosic fibrous material, generally wood chips, is digested, by heating, in a pulping liquor, known as white liquor and containing sodium sulphide and sodium hydroxide as the active pulping chemicals to provide a pulp and spent pulping liquor, known as black liquor. The black liquor is separated from the pulp by washing in a brown stock washer and the pulp then is passed to the bleach plant for brightening and purification operations.

The black liquor then is passed to the recovery and regeneration system in which the black liquor first is concentrated, usually by evaporation, and the concentrated black liquor is burned in a furnace to yield a smelt containing sodium carbonate and sodium sulphide. A sodium-and sulphur-containing compound, generally sodium sulphate, is added to the black liquor generally prior to feed of the concentrated black liquor to the furnace, although such sodium-and sulphur-containing compound may be added at any other convenient point, such as to the white liquor prior to the digestion step to make up sodium and sulphur values lost from the recovery system.

The smelt is dissolved in water to yield a raw green liquor which then is clarified to remove undissolved solids. The clarified green liquor is causticized with reburned lime whereby the sodium carbonate is converted to sodium hydroxide. The resulting liquor is white liquor which then may be recycled to the digestion step to provide at least part of the pulping liquor.

Bleach plant operations generally involve a sequence of brightening and purification steps, together with washing steps. The brightening steps generally involve the use of bleaching agents. In the present invention, at least one of the brightening steps preferably involves the use of at least one chlorine-containing bleaching agent. Such chlorine-containing bleaching agents include chlorine, chlorine dioxide, chlorine monoxide and sodium hypochlorite.

The purification steps generally involve treatment with sodium hydroxide solution, and usually is known as a caustic extraction step. In some instances, the bleaching and caustic extraction steps may be combined, for example, using the so-called "oxygen bleaching" operation. Where the oxygen bleaching operation is used, however, it is used in this invention preferably in combination with one or more bleaching operations using chlorine-containing bleaching chemicals.

A particular bleaching operation which has been employed involves an initial bleaching of the pulp with an aqueous solution containing chlorine or a mixture of chlorine dioxide and chlorine, an intermediate washing, a caustic extraction using aqueous sodium hydroxide solution, a further washing, a bleaching with an aqueous solution of chlorine dioxide, another washing, a further caustic extraction using aqueous sodium hydroxide, an additional washing, a final bleaching with chlorine dioxide solution and a final washing. This is the socalled CEDED operation. The present invention will be described with particular reference to this procedure, although other procedures may be employed, such as, the use of an aqueous solution containing approximately 100% chlorine dioxide in the first bleaching step.

The above-described CEDED operation may be carried out using the so-called "Dynamic Bleaching" process claimed in Canadian Pat. No. 783,483. In this process, pulping treating solutions are passed successively through a mat of fibers in which the fibers are maintained relative stationary with respect to each other. Washing steps, except for a washing after the last step of the bleaching and purification sequence may be omitted.

The spent wash waters from bleach plants generally have been discharged to water bodies, such as streams, rivers, lakes and oceans, without any attempt to recover chemicals therefrom, although in some instances solid particle recovery operations have been made. One of the main reasons that no attempt has been made to recover these chemicals is because they are very dilute and of small value. The bleach point also produces spent bleaching liquor effluents and spent caustic extraction effluents. These effluents have objectionable colour and are toxic and harmful to aquatic and marine biota and polluting since they contain fibers and materials consuming oxygen present in the water. It is desirable to avoid such environmental pollution, and hence avoid the discharge of these effluents from the mill.

Due to the use of chlorine-containing bleaching chemicals and sodium-containing purification agents, the spent wash water contains substantial quantities of sodium chloride. In addition, when the spent bleaching liquor effluents and the spent caustic extraction liquor effluents are extraction liquor effluents are mixed at least part of the residual chlorine and soda values combine to form sodium chloride. In the present invention, the normally discharged effluents, namely, the spent wash water, the spent bleaching chemicals and the spent caustic extraction liquor preferably are mixed to provide a bleach plant effluent stream, known as BPE.

The quantity of the chlorine containing bleaching agents and the quantity of sodium hydroxide used as caustic extraction liquor preferably are balanced to provide about one atom of sodium for each atom of chlorine, whereby these chemicals form sodium chloride. In practice, the quantity of sodium hydroxide solution is in a slight stoichiometric excess to ensure the conversion of all the chlorine values to sodium chloride. The equivalence of sodium and chlorine atoms in the bleach plant effluent is preferred so that the overall sodium inventory of the mill thereby remains unchanged. In the CEDED sequence when chlorine or mixtures of chlorine dioxide and chlorine in which the proportions of available chlorine provided by chlorine dioxide is low, is used in the first stage an amount of sodium hydroxide solution in excess of that required for extraction must be added to match the chlorine atoms present. If no excess is added, only about 40 to 50% of the chlorination stage filtrate can be recovered to match the stoichiometric equivalent of sodium atoms used in the extraction. Where, however, the available chlorine is provided predominantly by chlorine dioxide, typically above about 70%, the quantities of sodium and chlorine atoms are substantially equivalent and hence it is preferred to employ the latter sequence.

Sodium chloride present in the pulp mill system may arise from other sources. Such sodium chloride may be present where the logs are floated in sea water prior to formation of wood chips therefrom. The use of seaborne logs also causes there to be present in the black liquor sodium chloride and other alkali metal chlorides from washing of the pulp in the brown stock washer. In addition, if brackish water is used to provide process make up water, sodium chloride again is present to the bleach plant effluent.

In the present invention, the bleach plant effluent preferably is added to the spent pulping liquor recovery and regeneration operation, and in this way retains this effluent within the mill. It has been proposed previously in Canadian Pat. No. 832,347 and U.S. Pat. No. 3,698,995 to reduce the environmental problems of bleach plant effluent by utilizing the spent wash waters to wash the pulp in the brown stock washer. The use of the spent wash water in this manner reduces the overall water requirement of the mill. In the present invention, it is preferred to use the bleach plant effluent, consisting of a mixture of spent wash waters, preferably provided by countercurrent washing as described in Canadian Pat. No. 832,347 and U.S. Pat. No. 3,698,995, spent bleaching chemicals and spent caustic extraction liquor, to wash the pulp in the brown stock washer and provide thereby an "effluent-free" pulp mill.

In a particular manner of carrying out such countercurrent washing in a CEDED sequence in which the pulp is washed after every step, there is a completely countercurrent flow of liquors, namely spent bleaching liquors, spent caustic extraction liquors and wash water, with respect to the flow of pulp through the bleach plant. In such an operation, fresh water or white water is passed into contact with the pulp following the last bleaching stage, the spent wash water from this washing being mixed with spent chlorine dioxide from the last bleaching stage. The resulting mixture is split into two streams, the bulk being used to wash the pulp from the last caustic extraction stage, and the remainder being used to mix with spent caustic extraction effluent from the last caustic extraction stage, the mixture being used partially to mix with effluent from the washing step after the intermediate bleaching stage.

The remainder of the mixture is used as wash water to wash the pulp from the intermediate bleaching stage. Spent bleaching chemical from this stage is mixed with the aqueous material resulting from the last mixing, the resulting material, representing the combined effluents from the subsequent steps of the bleach plant, being used partially to wash the pulp from the first caustic extraction stage and partially to wash the pulp from the first bleaching stage. The spent wash water from the washing of the pulp from the first caustic extraction stage is mixed with spent caustic extraction liquor from the first caustic extraction and the mixture is divided into two streams, one of which represents an alkaline effluent and the other is used as wash water for the pulp from the first bleaching stage. The spent wash water from this stage is mixed with spent bleaching chemical from the first bleaching stage to provide an acid liquor, part of which constitutes an acid bleach plant effluent.

Another part of the acid liquor may be used to mix with the pulp received from the brown stock washer to provide the water required to bring the pulp to the consistency necessary in the first bleaching stage. A further part of the acid liquor is used as the aqueous medium for gaseous chlorine used in the first bleaching stage. In this way a portion of the acid liquor, constituted by the latter two parts may be recycled in the first bleaching step.

A further part of the acid liquor may be used as wash water to displace into but not through the unbleached pulp on the unbleached decker so that it is substantially all discharged to the unbleached decker chest along with the unbleached pulp.

Still another part of the acid liquor may be used as wash water to wash the screen on the first bleaching stage washer so that it mixes with spent bleaching chemical from the first bleaching stage and is recycled to become part of the acid liquor.

The acid spent bleaching chemical liquor is mixed with the alkaline caustic extraction liquor to provide the bleach plant effluent.

The bleach plant effluent may be introduced at other stages of the recovery and regeneration operations. Further, the bleach plant effluent may be split into two or more streams which are introduced at different locations of the recovery and regeneration operations, for example, to wash calcium carbonate mud to provide the "weak wash" water or to dilute concentrated white liquor. In addition, portions of the acid spent bleaching chemical liquor and/or the alkaline caustic extraction liquor may be separately introduced at different locations of the recovery and regeneration operation.

The quantity of sodium chloride present in the bleach plant effluent varies depending on the bleaching sequence which is employed. In a typical procedure where a mixture of chlorine dioxide and chlorine are utilized in the first stage of a CEDED sequence the quantity of sodium chloride may vary between about 120 and 160 lbs/ton of pulp depending on the proportion of chlorine dioxide used. Typically, when the total available chlorine in the first stage is provided 70% by chlorine dioxide and 30% by chlorine, the quantity is about 120 lbs/ton of pulp.

The introduction of the bleach plant effluent to the pulping liquor recovery and regeneration operations closes the whole system and sodium chloride is not purged by way of discarded bleach plant effluent. The sodium chloride remains unconverted by the black liquor recovery steps and hence would build up in the system. In order to prevent such build up and at the same time utilize the concepts of an effluent-free pulp mill, it is essential to remove sodium chloride from the system. Such removal of sodium chloride should be such that the other valuable components utilizable as or convertible into pulping chemicals are not removed from the system along with the sodium chloride. In addition, it is preferred to remove a quantity of sodium chloride from the mill equivalent to the amount introduced to and/or produced within the mill, typically about 120 lbs/ton pulp.

The process described and claimed in Canadian Pat. No. 915,361 and the corresponding U.S. Pat. No. 3,746,612 makes it feasible to provide an effluent-free pulp mill by removing from the mill on a continuous basis an amount of sodium chloride equivalent to the amount of chloride introduced to the recovery and regeneration system. This is achieved by concentrating, preferably by evaporation, the white liquor prior to recycle to the digestion stage in order to precipitate and remove sodium chloride from the white liquor.

In the causticization of the sodium carbonate to sodium hydroxide, less than 100% efficiency is experienced, and upon concentration of the white liquor to precipitate sodium chloride, the unconverted sodium carbonate, i.e. an unregenerated pulping chemical, also is precipitated. As described in Canadian Pat. No. 915,362 and its corresponding U.S. Pat. No. 3,740,307, pure sodium chloride is recovered from the material precipitated in the white liquor concentration step and an aqueous solution of the sodium carbonate precipitate together with some of the sodium chloride is formed and this aqueous solution is recycled to the green liquor, so that the sodium carbonate values are not lost from the mill.

It now has been found that in many instances the spent pulping liquor recovery and regeneration operations are inefficient and in this way the white liquor also may contain, besides sodium carbonate, other inert or unregenerated pulping chemicals, generally in the form of sodium- and sulphur-containing compounds. Upon concentration of the white liquor in accordance with the procedure of the above-mentioned Canadian Pat. No. 915,361 and U.S. Pat. No. 3,746,612, some of the unregenerated pulping chemicals are coprecipitated with the sodium chloride. If the separation and recycle procedure of the above-mentioned Canadian Pat. No. 915,362 and U.S. Pat. No. 3,740,307, is used the recycle solution will contain the unregenerated pulping chemicals which rapidly would build up and prevent the separation of adequate quantities of pure sodium chloride.

SUMMARY OF THE INVENTION

The present invention seeks to overcome these prior art problems and provide an effluent-free pulp mill. In its broadest aspect, the present invention provides a pulp process in which spent pulp liquor is subjected to a recovery and regeneration operation to form a pulping liquor containing active pulping chemicals, unregenerated pulping chemicals and sodium chloride. Unregenerated pulping chemicals and sodium chloride are removed in solid form from at least part of the pulping liquor, substantially pure sodium chloride is recovered and unregenerated pulping chemicals are recycled to the spent pulping liquor.

GENERAL DESCRIPTION OF INVENTION

In a preferred embodiment of the present invention, spent pulping liquor is subjected to a recovery and regeneration operation to form sodium hydroxide and sodium salt-containing pulping liquor for recycle to the digestion stage, bleach plant effluent from a brightening and purification sequence utilizing chlorine-containing bleaching chemicals and sodium-containing purification chemicals and hence containing dissolved quantities of sodium chloride is introduced to the recovery and regeneration operation prior to the formation of pulping liquor, solid materials are removed from the pulping liquor consisting substantially of unregenerated pulping chemicals and spent bleaching chemicals constituted by sodium chloride, pure sodium chloride is recovered, preferably in a quantity equivalent to that introduced to the recovery and regeneration operation with the bleach plant effluent and the spent pulping liquor, and unregenerated pulping chemicals are recycled to the spent pulping liquor.

The unregenerated pulping chemicals present in the white liquor generally consist of sodium carbonate and sodium- and sulphur-compounds where the pulping system utilizes sodium- and sulphur-based pulping chemicals, typically sodium sulphate, sodium sulphite, sodium thiosulphate and sodium polysulfide, although other minor components also may be present. Of these materials, the sodium sulphate is present in the most significant amount.

Some of these salts usually remain in solution during white liquor concentration procedures, typically sodium thiosulphate and sodium polysulphide. These materials in the white liquor recycled to the digestion stage do not build up since they are subjected to the recovery and regeneration operation when the spent pulping liquor containing these recycled materials is forwarded to such operation.

The unregenerated pulping chemicals which are coprecipitatable with sodium chloride from the white liquor consist mainly of sodium carbonate and sodium sulphate. The present invention is described hereinafter mainly with reference to these materials, but it will be understood that the principles are applicable to any other unregenerated pulping chemicals which are coprecipitatable from white liquor.

In accordance with a preferred aspect of the present invention, the quantity of sodium sulphate in the white liquor which is subjected to concentration in accordance with the process of the aforementioned Canadian Pat. No. 915,361 and U.S. Pat. No. 3,746,612 is controlled. This control may be provided by concentrating by evaporation the white liquor obtained from the causticization stage to cause precipitation of sodium sulphate and sodium carbonate, the concentration preferably being continued to substantially the saturation point of sodium chloride in the solution. The solids thus precipitated then are removed from the white liquor, which thereafter may be evaporated further in accordance with the process of Canadian Pat. No. 915,361 and U.S. Pat. No. 3,746,612 to cause precipitation of sodium chloride therefrom.

In one embodiment of this preferred aspect of the present invention, the evaporation of the white liquor, after removal of the precipitated salts, causes precipitation of sodium chloride and residual amounts of sodium carbonate and sodium sulphate, while leaving the active pulping chemicals, sodium hydroxide and sodium sulphide, in the liquor.

After separation from the concentrated white liquor, the precipitate from the second stage evaporation, consisting of a mixture of sodium chloride, sodium carbonate and sodium sulphate, may be treated as indicated in Canadian Pat. No. 915,362 and U.S. Pat. No. 3,740,307, or in any other convenient manner, to recover substantially pure sodium chloride therefrom and form an aqueous solution of the remainder of the precipitate for recycle to the green liquor, thereby to retain the carbonate and sulphate values of the second stage precipitate within the system. The quantities of carbonate and sulphate recycled in this way are generally maintained at substantially steady state values by the causticization procedure for the carbonate and the first stage evaporative precipitation of carbonate and sulphate.

In an alternative procedure, the precipitate from the second stage evaporation similarly is treated to recover substantially pure sodium chloride and form an aqueous solution of the remainder of the precipitate. Instead of recycling the latter aqueous solution to the green liquor, in accordance with the above procedure and following the procedure of Canadian Pat. No. 915,362 and U.S. Pat. No. 3,740,307, the aqueous solution may be recycled to the white liquor prior to the first stage concentration. It is possible to operate in this manner since, contrary to the procedures of Canadian Pat. No. 915,362 and U.S. Pat. No. 3,740,307, the sodium carbonate content of the solution to be recycled need not pass directly to the causticizer to prevent its build up, since it is removed in the present invention, in the first stage concentration and is recycled with the sodium sulphate to the spent pulping liquor, and, in this way, the sodium carbonate is returned to the causticizer, thereby retaining the sodium carbonate values in the mill. Recycle of the aqueous solution of the remainder of the precipitate in this manner reduces the sodium chloride concentration in the recausticization step.

The latter aqueous solution of sodium carbonate, sodium sulphate and sodium chloride also may be recycled to the furnace, typically by addition to the digester or the black liquor. However, in order to minimize the quantity of sodium chloride to which the furnace is exposed it is preferred to recycle the aqueous solution to the green liquor or white liquor as discussed above.

The concentrated white liquor resulting from the second stage evaporation, after dilution, if required, may be recycled to the digester to form at least part of the pulping liquor.

In a second embodiment of this aspect of the invention, the first stage concentration to deposit a mixture of sodium sulphate and sodium carbonate is carried out by evaporation to the substantial saturation by the white liquor by sodium chloride. The liquor resulting from the first stage evaporation is allowed to cool or is cooled.

Substantially pure sodium chloride is precipitated during the cooling and thereafter is removed from the white liquor. The sodium chloride recovered is substantially pure although it may be contaminated with very small quantities of sodium carbonate and/or sodium sulphate. The relative concentrations of the sodium chloride, sodium sulphate and sodium carbonate in the white liquor following the first stage evaporation are such that the sodium chloride precipitation proceeds in this manner. The cooling step may be accompanied by some evaporation of water, as in a flash cooling operation.

Following the precipitation and removal of the substantially pure sodium chloride, the white liquor preferably is subjected to a further evaporation step to precipitate further amounts of sodium chloride and residual amounts of sodium carbonate and sodium sulphate, while leaving the active pulping chemicals, sodium hydroxide and sodium sulphide in the liquor.

The precipitate obtained in this second concentration step is removed from the concentrated white liquor and may be formed into an aqueous solution for recycle to the green liquor, or to the white liquor prior to the first stage-concentration, as discussed above in connection with the first embodiment of this aspect of the invention, thereby retaining the carbonate and sulphate values within the mill. The quantities of carbonate and sulphate recycled in this way are maintained at substantially steady state values by the causticization procedure for the carbonate and the first stage evaporation for carbonate and sulphate.

The mixture of sodium chloride, sodium carbonate and sodium sulphate may be fractionated, if desired, in accordance with the first aspect of this embodiment to recover further quantities of substantially pure sodium chloride, the resulting solution being recycled to the green liquor or white liquor prior to the first stage concentration.

Alternatively, the solid mixture of sodium chloride, sodium carbonate and sodium sulphate, recovered in this second evaporation step, or the aqueous solution thereof resulting from leaching of the precipitate may be fed to the furnace, typically by feed to the concentrated black liquor or to the digester. However, in order to minimize the sodium chloride load on the furnace, it is preferred to recycle this material to the green liquor or white liquor prior to the first evaporation step, as discussed above.

The concentrated white liquor resulting from the second stage evaporation, after dilution, if required, may be recycled to the digester.

In a third embodiment of this aspect of the invention, the first stage concentration of the white liquor is carried out by evaporation to the substantial saturation of the white liquor with sodium chloride. The resulting precipitated mixture of sodium carbonate and sodium sulphate is removed from the white liquor.

The white liquor then is allowed to cool, as described above with reference to the second embodiment of this aspect of the invention, to precipitate substantially pure sodium chloride. This precipitated material is removed from the white liquor. The resulting white liquor thereafter is heated, without substantial evaporation, to the saturation concentration of sodium carbonate and sodium sulphate in the white liquor, while the concentration of sodium chloride is undersaturated.

Thereafter, the concentration of sodium chloride in the white liquor is increased until the saturation point is reached, resulting in precipitation of a mixture of sodium carbonate and sodium sulphate, which then is separated from the white liquor. This precipitate may be forwarded to the black liquor, if desired, or may be forwarded to the green liquor, or white liquor prior to concentration.

The concentration of the sodium chloride content of the white liquor may be achieved by adding solid sodium chloride to the solution. The added quantity of sodium chloride may be recovered by a further evaporation step after separation of the precipitated mixture of sodium sulphate and sodium carbonate. Alternatively, the concentration of the sodium chloride content may be achieved by evaporation of the white liquor. Concentrated white liquor may be recycled, after dilution, if desired, to the digestion stage.

At least part of the precipitate separated from the white liquor after the first stage concentration in this aspect of the present invention is passed to the furnace, typically by addition to the concentrated black liquor or to the digester. Usually, all the precipitate is passed to the furnace, and in this way, the bulk of the unregenerated pulping chemicals, i.e. sodium sulphate and sodium carbonate, are recycled to the recovery and regeneration operation.

Where part only of the precipitate from the first stage concentration is passed to the furnace, the remainder may be recycled to the green liquor. The quantity of sodium sulfate present in the recycled white liquor increases by this procedure. The solids burden on the furnace is decreased since a proportion of the sodium carbonate precipitated in the first stage concentration does not pass through the furnace. In this manner, the additional inorganic solids loading to the furnace carried by the introduction and recirculation of sodium chloride may be completely offset by the decreased sodium carbonate load on the furnace.

Thus, in this aspect of the present invention, the bulk of the unregenerated pulping chemicals are recovered from the white liquor separate from the spent bleaching chemicals, i,e, the sodium chloride, and hence is in a form for direct return to the recovery and regeneration operation. In addition, substantially pure sodium chloride is recoverable from the white liquor, in a quantity substantially equal to that introduced to the recovery and regeneration operation, if desired, while the remainder of the unregenerated pulping chemicals are maintained within a closed loop in the regeneration operation at the green liquor stage, or in the white liquor concentration stage, depending on the procedure adopted.

In accordance with a further aspect of the present invention, the white liquor is subjected to evaporation in accordance with the procedure of Canadian Pat. No. 915,361 and U.S. Pat. No. 3,746,612, in a single step to result in precipitation of a mixture of sodium carbonate, sodium sulphate and sodium chloride.

The precipitate, after removal from the concentrated white liquor, then is subjected to fractionation to recover substantially pure sodium chloride from the precipitate. The removed precipitate contains crystals of sodium chloride which are large cubic crystals, crystals of sodium carbonate which are small and needle-like and crystals of burkeite (double salt of sodium carbonate and sodium sulphate) which are small and flat.

The precipitate is slurried with an aqueous solution saturated with sodium chloride, sodium carbonate and sodium sulphate and passed upwardly through a tower, resulting in separation out of the heavier and larger sodium chloride crystals while the sodium carbonate and burkeite crystals continue in suspension out of the tower. These latter crystals may be removed from the slurry and collected in any convenient manner.

Alternatively the slurry may be passed through a sieve plate which allows the sodium carbonate and burkeite crystals to pass through, but not the larger sodium chloride crystals. The retained sodium chloride crystals then are recovered from the sieve plate. The slurry, after removal of the sodium chloride on the sieve thereafter may be treated to remove the sodium carbonate and burkeite crystals, such as by contact with a fine sieve through which the crystals cannot pass.

The slurry may be constituted by the concentrated white liquor and the deposited salts resulting from the concentration of the white liquor. The liquor remaining after separation of the solid phase from the slurry may be recycled to the digester to provide at least part of the pulping liquor.

These fractionation procedures achieve substantial separation of sodium chloride from the sodium sulphate and sodium carbonate in the precipitate. The resulting mixture of sodium sulphate and sodium carbonate, constituting unregenerated pulping chemicals, is returned, at least partially to the furnace, such as by addition to the concentrated black liquor or digester. Part of the mixture may be recycled to the green liquor, if desired, as discussed above in connection with the first aspect of the invention.

The sodium chloride removed from the pulp mill by the present invention may be utilized in a number of ways, as desired. Typically, the sodium chloride is utilized to regenerate bleach plant chemicals. For example, the sodium chloride may be used to generate sodium hydroxide by electrolysis of an aqueous solution thereof, the sodium hydroxide being used in the bleach plant. Alternatively, the sodium chloride may be used to generate chlorine dioxide and chlorine by reaction with sodium chlorate and sulphuric acid, the chlorine dioxide and chlorine being used in the bleach plant. Further, the sodium chloride may be electrolyzed as an aqueous solution to sodium chlorate for use in a chlorine dioxide producing reaction involving reduction of the sodium chlorate in an acid medium.

DESCRIPTION OF PREFERRED EMBODIMENTS

Figure 1:
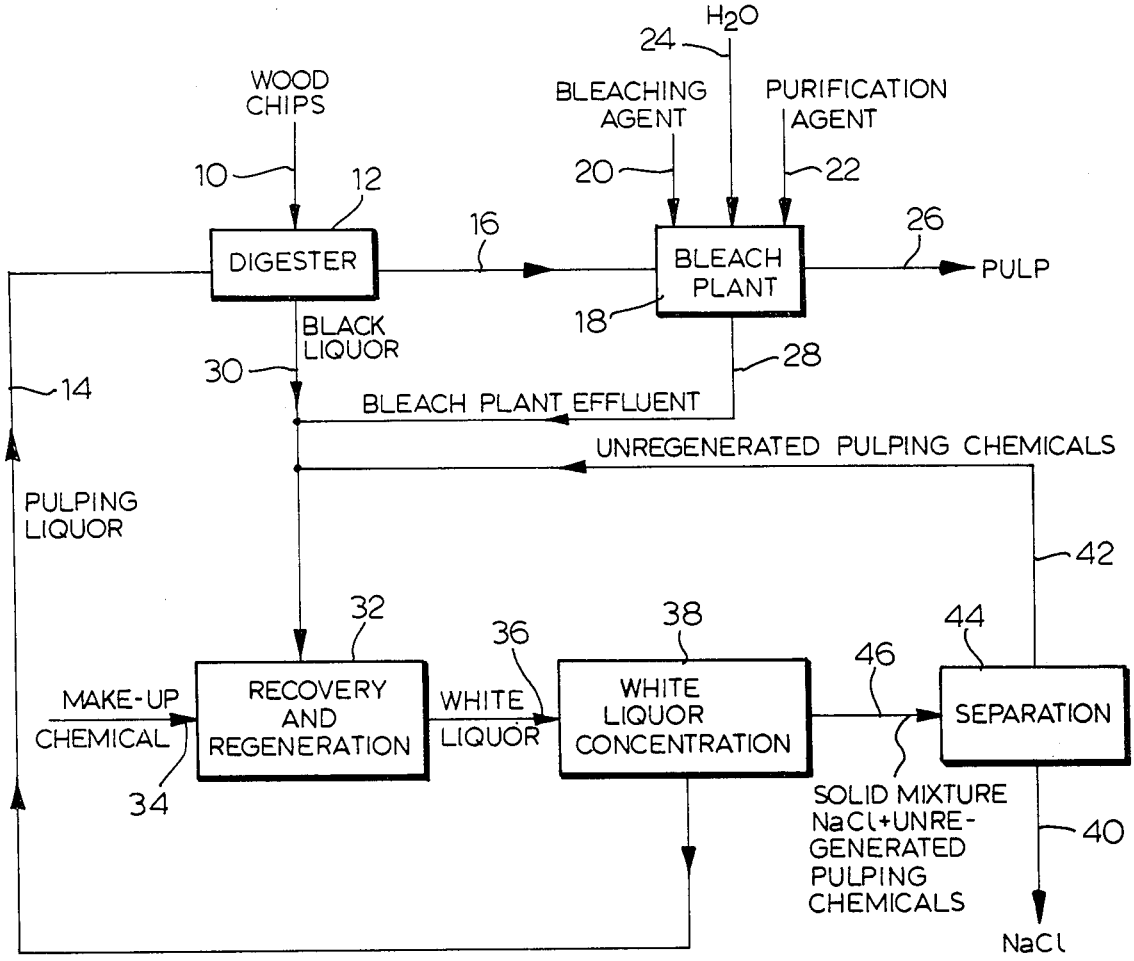
FIG. 1 is a schematic flow sheet of one embodiment of the invention.

Wood chips, or other raw cellulosic fibrous material, are fed by line 10 to a digester 12 wherein the wood chips are digested with a pulping liquid fed by line 14. The pulping liquor contains an alkali metal, generally sodium, pulping material.

The resulting pulp passes from the digester 12 by line 16 to a bleach plant 18. Usually, the pulp is washed before passage to the bleach plant 18. In the bleach plant 18, the pulp is subjected to bleaching operations with one or more chlorine-containing bleaching agents fed by line 20, such as chlorine and chlorine dioxide. In addition, the pulp is subjected to purification steps, by contact with a purification agent fed by line 22. Generally, the purification agent is sodium hydroxide. The pulp also is washed in the bleach plant by water fed through line 24, generally after each bleaching operation and after each caustic extraction operation. The resulting pulp leaves the bleach plant 18 by line 26 and is sold as such or passed to further operations to be converted into paper or other pulp products.

The spent solutions from the bleach plant leave the plant 18 by line 28 to be passed with the spent pulping liquor, or "black" liquor in line 30 to the recovery and regeneration operation 32.

In the recovery and regeneration operation 32 the black liquor is subjected to a series of operations, depending on the particular pulping liquor fed by line 14, with appropriate make up chemicals being added by line 34. The make up chemicals also may be added to the pulping liquor in line 14 or to the white liquor in line 36.

The white liquor resulting from the recovery and regeneration operation 32 by line 36 contains dissolved quantities of spent bleach plant chemicals, in the form of sodium chloride, and unregenerated pulping chemicals, resulting from inefficiencies in the recovery and regeneration procedures. At least part of the white liquor then is subjected to concentration by evaporation in a concentration zone 38. The particular manner or procedure of concentration is immaterial and two particular embodiments are discussed below with reference to FIGS. 2 and 3.

The concentration procedure usually is carried out on all the white liquor, but may be carried out on only part thereof, if desired, when smaller amounts of sodium chloride are desired to be recovered.

The concentrated white liquor then is recycled to the digester 12 by line 14 as at least part of the pulping liquor used therein, with dilution, if required.

The concentration results in the removal from the white liquor of sodium chloride and unregenerated pulping chemicals. These materials are separated to recover sodium chloride in line 40 and unregenerated pulping chemicals in line 42. The unregenerated pulping chemicals are recycled to the recovery and regeneration operation 32 by addition at least in part to the black liquor in line 30, to the pulping liquor in line 14, to the digester 12 or to the make up chemicals in line 34.

The separation of the sodium chloride and the unregenerated pulping chemicals may be combined with the white liquor concentration in zone 38, such as in the specific procedures described below with reference to FIGS. 2 and 3. Alternatively, a separate separation zone 44 may be provided to which a mixture of sodium chloride and unregenerated pulping chemicals may be passed by line 46 from the white liquor concentration zone 38. In this alternative, the solid materials are deposited from the white liquor by a single concentration step typically by evaporation by the procedure outlined in the above-mentioned Canadian Pat. No. 915,361 and U.S. Pat. No. 3,746,612.

The separation of the pure sodium chloride from the solid mixture may be achieved in a number of ways, typically by slurrying the solid mixture with a saturated solution of the sodium chloride and unregenerated pulping chemicals and passing the slurry upwardly through a tubular column. The sodium chloride, being in the form of large crystals, separates to the bottom of the column and may be removed therefrom, while the smaller sized crystals of unregenerated pulping chemicals pass out of the column. The latter crystals are separated from the slurry and are forwarded by line 42 to the recovery and regeneration operation 32 in solid form or as an aqueous solution thereof. Alternatively, the unregenerated pulping chemicals in line 42 may be added to the white liquor in line 14 and in this way are returned to the recovery and regeneration zone 32.

Figure 2:
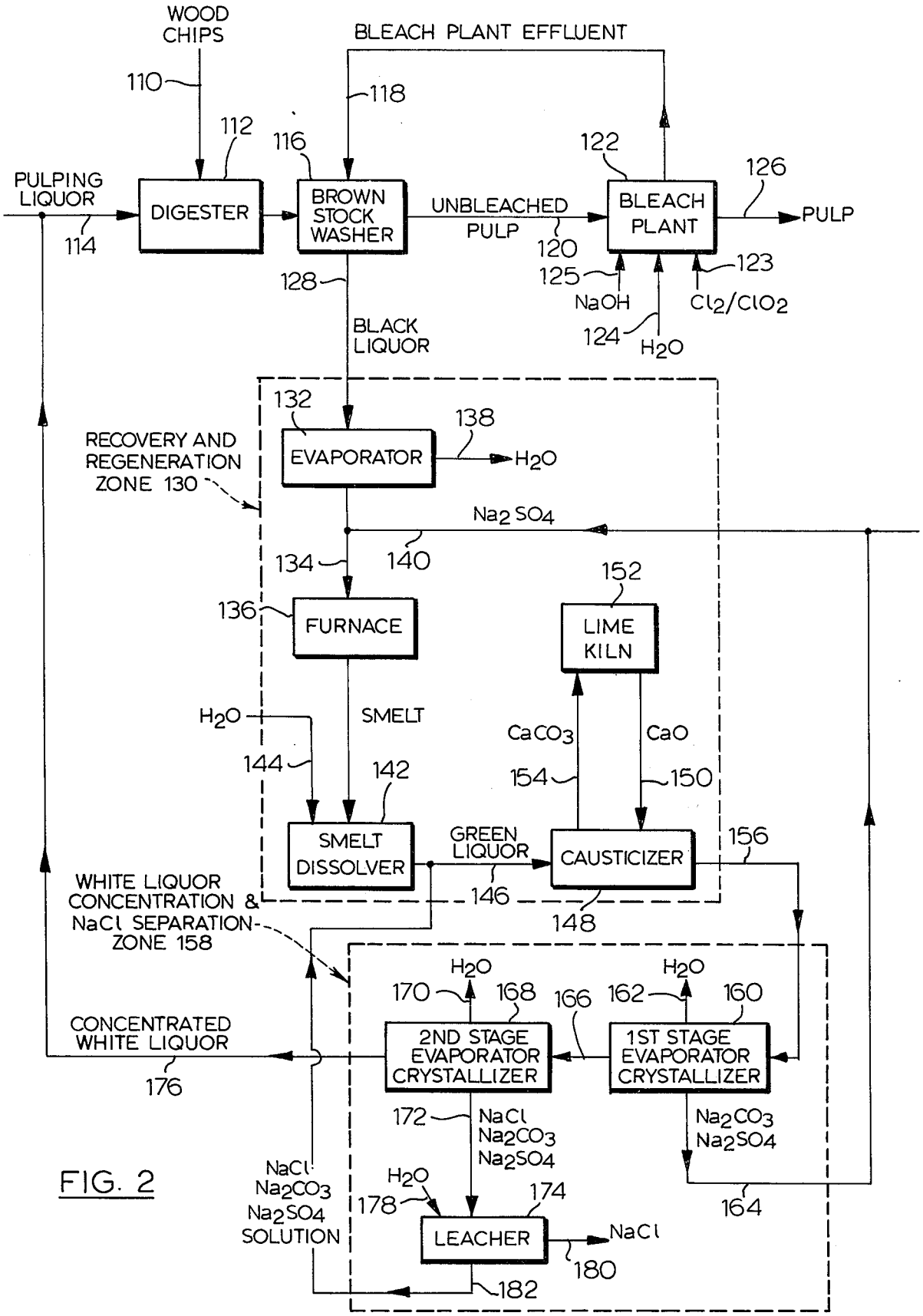
FIG. 2 is a schematic flow sheet of a second embodiment of the invention.

Turning now to consideration of FIG. 2, there is shown a specific embodiment of the procedure described above with reference to FIG. 1. Wood chips, or other cellulosic fibrous material, are fed by line 110 to a digester 112 wherein the wood chips are digested with a pulping liquor fed by line 114 and containing sodium sulphide and sodium hydroxide as the active pulping chemicals, and hence utilizing the Kraft process.

The resulting pulp and black liquor or spent pulping liquor are separated and the pulp is washed in a brown stock washer 116. The pulp is washed, in the embodiment illustrated, with aqueous bleach plant effluent fed by line 118. Alternatively, the pulp may be washed with water or "contaminated condensate", and the bleach plant effluent may be utilized elsewhere in the system, as described in more detail below. In order to avoid the formation of hydrogen sulphide during this washing step when the bleach plant effluent is used, it is preferred to provide the bleach plant effluent at neutral or slightly alkaline pH, typically around pH 9.

The washed and unbleached pulp is fed by line 120 to a bleach plant 122 wherein the pulp is subjected to a series of bleaching and purification processes, at least one of the bleaching steps involving the use of one or more chlorine-containing bleaching agents. Generally the bleaching and purification processes involve bleaching with chlorine, chlorine dioxide or mixtures thereof fed by line 123 and purification by caustic extraction, using aqueous sodium hydroxide solution fed by line 125, typically in a CEDED sequence as described above. The pulp is washed during the bleach plant operations, typically after each bleaching or caustic extraction operation, by water fed by line 124. The spend wash water from the bleach plant washing operations together with the spent chemicals from the bleaching and caustic extraction steps provide the bleach plant effluent in line 118. Preferably, the washing operations involve countercurrent flow of pulp and wash water. Preferably, the quantity of sodium hydroxide used in the caustic extraction of the pulp is slightly in excess of the stoichiometric requirement of one sodium atom for each chlorine atom in the bleaching chemicals, whereby the bleach plant effluent in line 118 has an alkaline pH, as mentioned above. The bleached and purified pulp of required brightness is recovered from the bleach plant 122 by line 126 and is passed to papermaking procedures.

If desired, the bleach plant effluent in line 118 may be added directly to the black liquor in line 128, although this procedure is less preferred, since the water requirement is increased.

The bleach plant effluent in line 118 contains considerable quantities of sodium chloride which are transferred to the black liquor in line 128. The black liquor is passed to a recovery and regeneration zone 130 for recovery of spent pulping chemicals and regeneration of pulping liquor. In the recovery and regeneration zone 130 the black liquor first is evaporated in an evaporator 132, prior to passage by line 134 to a furnace 136 of any convenient construction. The water recovered from the evaporator 132 by line 138 may be used to provide at least part of the water required of the system, for example, as at least part of the water fed to the bleach plant in line 124, after suitable cleaning, if required.

Sodium sulphate or other source of sodium and sulphur values, such as spent acid, is added to the recovery and regeneration zone, typically be addition to the black liquor, either in solid form or as an aqueous solution thereof by line 140, for example, after evaporation in the evaporator 132. The sodium sulphate fed by line 140 is used to make up the sodium and sulphur values lost from the system in the chemical recovery and regeneration processing steps.

The black liquor forms in the furnace 136 a smelt containing sodium sulphide and sodium carbonate, and additionally unreacted components, such as spent bleaching chemicals, i.e. sodium chloride, and sodium sulphate and other sodium sulphur-oxygen salts. The smelt is dissolved in a smelt dissolver 142 by water, generally weak wash water from the washing of calcium carbonate mud, fed by line 144, to form a green liquor. The quantity of sodium sulphate and other sodium sulphur-oxygen salts present in the green liquor depends on the efficiency of the furnacing operation and the extent of oxidation of oxidisable sodium-sulphur salts, typically sodium sulphide, after furnacing.

The water passed by line 144 to the smelt dissolver 142 may be at least partially bleach plant effluent from line 118, especially in the case where fresh water or contaminated condensate is fed to the brown stock washer 116. Thus, the green liquor may also contain dissolved quantities of spent bleaching chemicals in the form of sodium chloride arising from the bleach plant effluent 118, whether all the bleach plant effluent in line 118 is used to wash the pulp in the brown stock washer 116, all the bleach plant effluent is used to form the green liquor from the smelt, the bleach plant effluent is used partially in the brown stock washer 116 and partially in the formation of the green liquor, or the bleach plant effluent is added directly to the black liquor in line 128.

If desired, the smelt may be fractionated to remove the sodium sulphide values therefrom and thereby provide a sulphide-lean green liquor, substantially free from sodium sulphide values.

The green liquor after clarification to remove dregs, is passed by line 146 to a causticizer 148 of conventional construction wherein the sodium carbonate values in the green liquor are to a large extent converted to sodium hydroxide by lime fed by line 150 from a lime kiln 152. The calcium carbonate precipitated from the resulting white liquor is separated and after washing to remove entrained white liquor (not shown) is returned to the lime kiln 152 by line 154. The aqueous solution resulting from this washing is known as "weak wash water" which may be used, as mentioned above, to form the green liquor.

The white liquor resulting from the causticization step in line 156 represents the effluent from the recovery and regeneration zone 130 and contains not only the active pulping chemicals sodium sulphide and sodium hydroxide but also sodium chloride as spent bleach plant chemicals, and unregenerated pulping chemicals in the form mainly of sodium sulphate and uncausticized sodium carbonate and additionally containing other unregenerated pulping chemicals in the form of sodium and sulphur-compounds.

In a typical Kraft mill operation, the white liquor in line 156 has a composition within the ranges:

| | |
|---|---|
| $NaOH$ | 7.5 to 9.7 % by weight |
| $Na_2S$ | 1.8 to 5 % |
| $Na_2CO_3$ | 1.7 to 3.1 % |
| $NaCl$ | 2.5 to 5 % |
| $Na_2SO_4$ | 0.1 to 1 % |

The white liquor in line 156 is passed to a white liquor concentration and sodium chloride separation zone 158. The white liquor in the white liquor concentration and separation zone 158 first is evaporated in a first stage evaporation 160 to precipitate sodium sulphate, sodium carbonate and other precipitable dissolved materials other than sodium chloride, until the white liquor is substantially saturated with sodium chloride, i.e. up to the point where further concentaation would result in the precipitation of sodium chloride The bulk of the sodium sulphate and sodium carbonate precipitate in this step, usually as anhydrous sodium carbonate and the double salt burkeite, $Na_2CO_3.2Na_2SO_4$. While other unregenerated pulping chemicals, which are present in only minor amounts, may be precipitated along with the sodium carbonate and sodium sulphate, the procedure is described with particular reference to the latter two chemcials. Generally, the white liquor is concentrated in the first stage evaporation 160 to about 26 to 32 weight % sodium hydroxide plus sodim sulphide.

Some unregenerated pulping chemicals, such as, sodium polysulphide and sodium thiosulphate, may remain dissolved in the white liquor removed from the zone 158.

In certain instances, the precipitation may be carried out to a point where the solution is less than saturated with sodium chloride. Further, co-precipitation of small quantities of sodium chloride in the first stage evaporator 160 may be tolerated.

The concentration of the white liquor in the first stage evaporator 160 preferably is carried out by evaporation, as described above, typically by boiling, if desired, under a reduced pressure. The first stage evaporator 160 may be of any convenient form, such as, a single evaporation vessel or may consist of a plurality of interlinked evaporation vessels, such as in the embodiment described below with reference to FIG. 4. The water resulting from the evaporation may be recovered in line 162 and utilized to provide part of the overall water requirement of the system.

The concentration of the white liquor in the first stage evaporator 160 deposits the bulk of the sodium sulphate and sodium carbonate from the white liquor. The salts precipitated from the white liquor, i.e. unregenerated pulping chemicals, in the first stage evaporator 160 are removed from the mother liquor by line 164 and, at least in part, are returned to the recovery and regeneration zone 130 at a pre-furnacing stage. Part of the precipitated salts may be passed to the green liquor in line 146, if desired. This recycle to the zone 120 may be carried out in any convenient manner. Preferably, the mixture is recycled to the black liquor with the sodium sulphate feed in line 140. The unregenerated pulping chemicals recovered by line 164 may be fed, in solid or aqueous solution form, to the zone 130 at any convenient location prior to furnace 136, for example, by addition to the digester 112 or the pulping liquor 114. By recycling these materials in this manner, the sodium, sulphur and carbonate values of the precipitate from the first stage evaporator 160 are recovered and utilized in the system.

The partially concentrated white liquor from the first stage evaporator 160 is passed by line 166 to a second stage evaporator 168. While two separate evaporators 160 and 168 are illustrated, this manner of illustration is for convenience in describing this embodiment of the invention. Two separate evaporation operations may be carried out in the same apparatus, with separation of solid precipitate from mother liquor after each operation. Alternatively, two or more separate evaporators may be employed, if desired.

The partially concentrated white liquor, saturated with respect to sodium chloride and residual amounts of sodium sulphate and sodium carbonate but not saturated with respect to the active pulping chemicals sodium sulphide and sodium hydroxide is evaporated in accordance with the process of the aforementioned Canadian Pat. No. 915,361 and U.S. Pat. No. 3,746,612 to precipitate therefrom the non-pulping chemical components, including sodium chloride. The evaporation of the white liquor in the second stage evaporator 168 may be carried out to precipitate part or substantially all the non-pulping components of the partially concentrated white liquor, and to a concentration of $NaOH + Na_2S$ of about 36 to 42 weight %.

The first stage evaporation operation therefore controls the concentration of unregenerated pulping chemicals in the white liquor which is then concentrated by the process of Canadian Pat. No. 915,361 and U.S. Pat. No. 3,746,612 to remove sodium chloride from the white liquor.

The evaporation of the partially concentrated white liquor in the second stage evaporator 168 preferably is carried out typically by boiling under a reduced pressure, if desired. The water resulting from the evaporation is recovered by line 170 and may be utilized to provide part of the water requirement of the system. For example, the water recovered by lines 162 and 170 may be used to provide at least part of the water fed to the bleach plant by line 124. The bulk of the water evaporated from the white liquor is evaporated in the first stage evaporator 160 with less than twenty percent being evaporated in the second stage evaporator 168.

The solid precipitate from the second stage evaporator 168 is removed therefrom by line 172 and is passed to a leacher 174. The solid precipitate removed by line 172 consists mainly of sodium chloride contaminated with quantities of unregenerated pulping components, consisting mainly of sodium carbonate and sodium sulphate, in the form of anhydrous sodium carbonate and burkeite. Sodium chloride generally constitutes in excess of 80% of this mixture.

The concentrated white liquor resulting from the second stage evaporator 168 having, in particular, a reduced sodium chloride-content, is passed by line 176 to provide at least part of the pulping liquor fed by line 114 to the digester 112. The concentrated white liquor in line 176 may be diluted with water or BPE, if desired, prior to passage to the digester 112. The water required for the dilution of the concentrated white liquor may be provided at least in part by water recovered in lines 138, 162 and 170.

The recycled concentrated white liquor may contain in addition to the active pulping chemicals, residual quantities of unregenerated pulping chemicals, such as sodium sulphate, sodium carbonate, sodium polysulphide and sodium thiosulphate. The presence of these materials in the recycled white liquor is not disadvantageous since the unregenerated pulping components pass through the digester and are subjected to recovery and regeneration operations in the zone 130. The recycled white liquor also may contain dissolved quantities of sodium chloride, which, while the sodium chloride present in the recycled white liquor is a dead load, under steady state conditions the quantity remains substantially constant since the quantity of sodium chloride removed from the white liquor in line 172 is approximately equal to the amount of sodium chloride introduced to the zone 130 from sources other than that present in the recycled white liquor. Generally, the concentration of sodium chloride in the recycled white liquor in line 176 is less than 35 grams/liter.

Water is fed to the leacher 174 by line 178 and the water dissolves the sodium carbonate, sodium sulphate, other contaminants and some of the sodium chloride to form an aqueous solution of these materials and leave substantially pure sodium chloride which is recovered by line 180, after washing, if required, to remove entrained liquor. Where such washing occurs, the spent wash water may be used to provide part of the water fed to the leacher by line 178. It is possible to achieve the separation of the solid mixture by utilizing any convenient technique other than leaching to recover pure sodium chloride therefrom.

Thus the mixture of sodium chloride, sodium carbonate and sodium sulphate recovered by line 172 may be subjected to any convenient operation to recover substantially pure sodium chloride in line 180, such as the hydraulic separation technique described above with respect of FIG. 1. Where such hydraullic separation occurs, prior separation to the deposited mixture from the concentration white liquor is not essential, as may be seen from FIG. 5 discussed below.

Therefore, in the white liquor concentration and separation zone 158, the white liquor fed from the recovery and regeneration zone 130 is subjected to evaporation to provide a white liquor in line 176 having a reduced sodium chloride and unregenerated pulping chemicals content. In addition, substantially pure sodium chloride is recovered by line 180 from the materials deposited by the white liquor concentration and the bulk of the unregenerated pulping chemicals deposited by the white liquor evaportion are recycled to a prefurnacing stage of the recovery and regeneration zone 130 by line 164.

In accordance with the process of the aforementioned Canadian Pat. No. 915,362 and U.S. Pat. No. 3,740,307, the aqueous solution resulting from the leacher 174 in line 182 may be recycled after filtration, if required, to the green liquor in line 146. The aqueous solution in line 182 may be recycled to the smelt dissolver 142 to combine with the water fed by line 144 to form the green liquor. Alternatively, the aqueous solution in line 182 may be added to a solution of the smelt in water leaving the smelt dissolver 142. In either case, the aqueous solution in line 182 is present in the green liquor fed to the causticizer 148. In this way, the remainder of the unregenerated pulping chemicals is recycled to the zone 130, at a post-furnacing stage.

Further, the aqueous solution in line 182 may be recycled to the white liquor in line 156 fed to the white liquor concentration and separation zone 158. In this instance, the recycle solution in line 182 is retained within the white liquor concentration and separation zone 158 and the quantity of sodium chloride in the recausticization area is reduced.

It is preferred to recycle the aqueous solution in line 182 to a post-furnacing stage in view of the sodium chloride content thereof and the desirability of limiting the quantity of sodium chloride to which the furnace is exposed. The quantity of the chemicals present in the recycled aqueous solution in line 182 under steady state conditions is substantially constant.

The sodium chloride recovered in line 180 may be put to a variety of uses, such as in the formation of chlorine dioxide, the production of sodium chlorate, or the formation of caustic extraction liquor, as is more fully described above.

In the absence of the first stage evaporation, the leaching operation of the sodium chloride-containing precipitate when substantial quantities of sodium sulphate are present is difficult to control to remove the desired quantity of pure sodium chloride from the system by line 180. To maintain a balanced operation, the leaching in the leacher 174 should be carried out preferably to remove from the system, on a continuous basis, substantially the same amount of sodium chloride as is introduced to the system from the various sources discussed above, mainly from the bleach plant effluent 118. In the presence of sodium sulphate, some of the sodium carbonate forms the double salt burkeite, which is less soluble than either sodium sulphate or sodium carbonate. Hence, in order to dissolve from the precipitate all of the sodium carbonate and sodium sulphate values more water is required and hence more sodium chloride is dissolved and less is recovered, as compared to operations where sodium sulphate is absent. As mentioned previously, the quantity of sodium sulphate present in the white liquor depends on the efficiency of the furnacing operation, the source and point of addition of the sodium and sulphur make up values, and the oxidation of sodium sulphide to sulphate in the processing steps. In some instances, the presence of sodium sulphate in the precipitate may be tolerated as the solubility reduction effect may be of little consequence. However, as higher quantities of sodium sulphate become present in the precipitate, the quantity of pure sodium chloride recoverable from the precipitate by leaching becomes less than that desired, namely at least equal to the quantity introduced to the system, and hence the operation becomes out of balance. Further, there is a tendency for the sodium sulphate concentration in the precipitate to build up during repeated recycle, thereby reducing further the efficiency, and hence the balance of the system.

Thus, by employing a first stage evaporation in accordance with this embodiment of the present invention, not only is the concentration of unregenerated pulping chemicals in white liquor reduced but also the efficiency of the system for the removal of sodium chloride is considerably improved.

Figure 3:
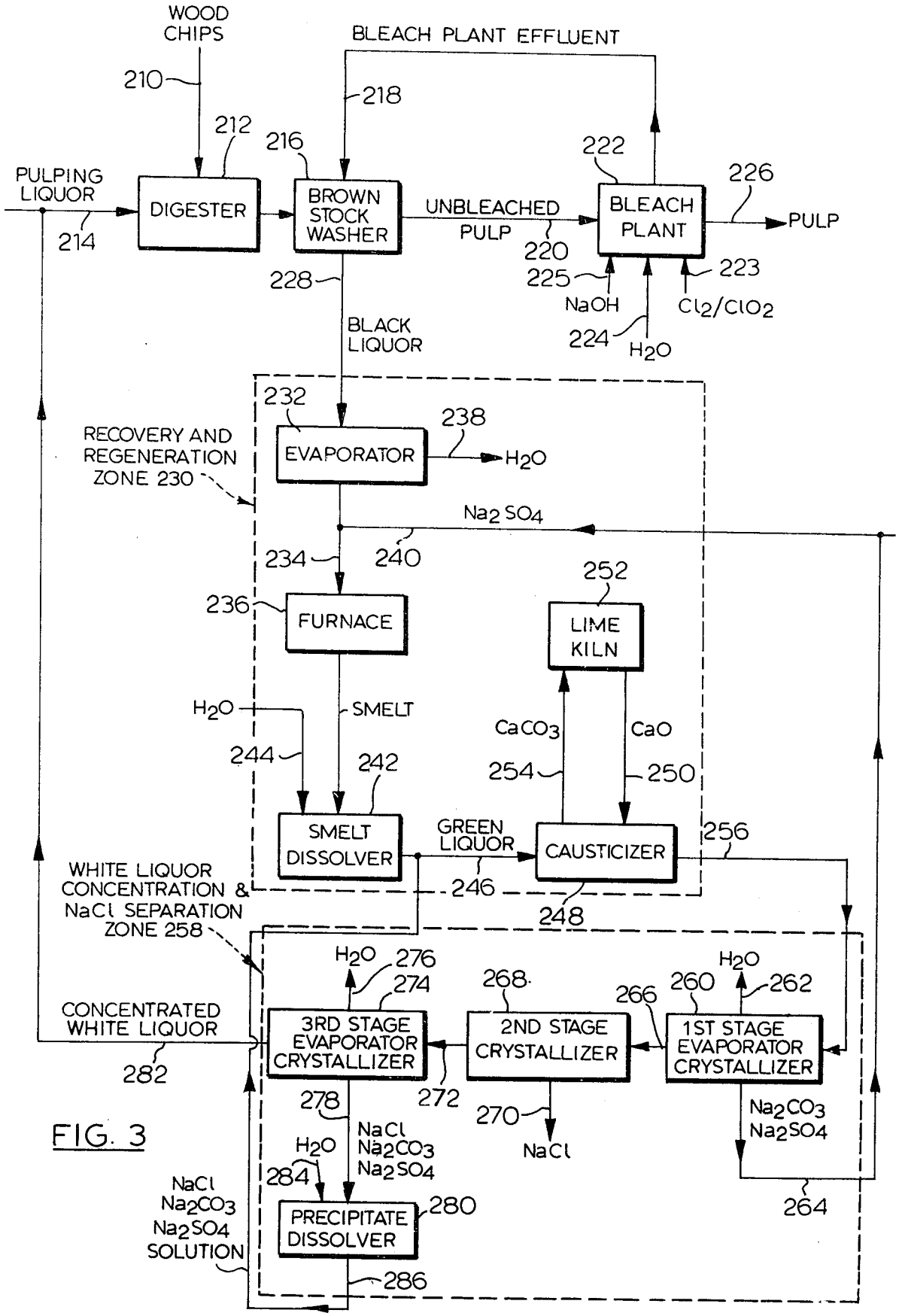
FIG. 3 is a schematic flow sheet of a third embodiment of the invention.

Turning now to consideration of the embodiment of FIG. 3, there is illustrated a procedure similar to that described above with reference to FIG. 2, with the exception of the operation in the white liquor concentration and sodium chloride separation zone. The alternatives described with reference to FIG. 2 with respect to the remainder of the system apply equally with respect to the embodiment of FIG. 3.

Wood chips are fed by line 210 to a digester 212 wherein the wood chips are digested with a Kraft system pulping liquor fed by line 214 and containing sodium sulphide and sodium hydroxide as the active pulping chemicals.

The resulting pulp and black liquor or spent pulping liquor are separated and the pulp is washed in a brown stock washer 216. The pulp is washed with aqueous bleach plant effluent fed by line 218.

The washed and unbleached pulp is fed by line 220 to a bleach plant 222 wherein the pulp is subject to a series bleaching and purification processes utilizing chlorine-containing bleaching chemicals, generally involving bleaching with chlorine, chlorine dioxide or mixtures thereof fed by line 223 and purification by caustic extraction, with aqueous sodium hydroxide fed by line 225, typically in a CEDED sequence as described above. The pulp is washed during the bleach plant operations, typically after each bleaching or purification operation, by water fed by line 224. A mixture of the spent wash water from the bleach plant washing operations, the spent bleaching chemicals and the spent caustic extraction chemicals provides the bleach plant effluent in line 218. Preferably, the washing operations involve countercurrent flow of pulp and wash water. The bleached and purified pulp of required brightness is recovered from the bleach plant 222 by line 226 and is passed to paper-making procedures.

The bleach plant effluent 218 contains considerable quantities of sodium chloride which is transferred to the black liquor in line 228. The black liquor is passed by line 228 to recovery and regeneration zone 230, wherein the spent pulping chemicals are recovered and pulping liquor is regenerated. In the zone 230, the black liquor first is evaporated in an evaporator 232 and prior to passage by line 234 to a furnace 236 of conventional construction. The water recovered from the evaporator 232 by line 238 may be used to provide at least part of the water requirement of the system.

Sodium sulphate or other source of sodium and sulphur values, such as spent sulphuric acid, is added to the recovery and regeneration zone 230, by addition to the black liquor, either in solid form or as an aqueous solution thereof by line 240, typically after evaporation in the evaporator 232. The sodium sulphate fed by line 240 is used to make up the sodium and sulphur values lost from the system in the chemical recovery and regeneration processing steps.

The black liquor forms in the furnace 236 a smelt containing sodium sulphide and sodium carbonate, and additionally inert components, such as sodium chloride, and unregenerated sodium-and sulphur-salts, mainly sodium sulphate, which is dissolved in a smelt dissolver 242 by water, generally weak wash water from the washing of calcium carbonate mud, fed by line 42, to form a green liquor. The quantity of sodium sulphate present in the green liquor depends on the efficiency of the furnacing operation and the extent of oxidation of sodium-sulphur salts after furnacing. Thus, the green liquor also contains dissolved quantities of sodium chloride arising from the bleach plant effluent in line 218.

If desired, the smelt may be fractionated to remove the sodium sulphide values therefrom and thereby provide a sulphide-lean green liquor, substantially free from sodium sulphide values.

The green liquor after clarification to remove dregs, is passed by line 246 to a causticizer 248 wherein the sodium carbonate values in the green liquor are to a large extent converted to sodium hydroxide by lime fed by line 250 from a lime kiln 252. The calcium carbonate precipitated from the resulting white liquor is separated and after washing to remove entrained white liquor (not shown) is returned to the lime kiln 252 by line 254.

The white liquor resulting from the causticization step in line 256 and leaving the recovery and regeneration zone 230 contains not only the active pulping chemicals sodium sulphide and sodium hydroxide but also sodium chloride, and unregenerated pulping chemicals in the form mainly of uncausticized sodium carbonate and sodium sulphate. The white liquor in line 256 may have a concentration in the ranges discussed above with reference to the white liquor in line 156.

As discussed above with reference to the embodiment of FIG. 2, the white liquor also may contain other unregenerated pulping chemicals. The action of these additional materials has been described above with reference to FIG. 2. They act in the same manner in this embodiment and hence further reference to and discussion of these materials is omitted.

The white liquor in line 256 is passed to a white liquor concentration and sodium chloride regeneration zone 258. The white liquor in the zone 258 first is evaporated in a first stage evaporator 260 to precipitate sodium sulphate and sodium carbonate until the white liquor is substantially saturated with sodium chloride; i.e. up to the point where further concentration would result in the precipitation of sodium chloride. In certain instances, the precipitation may be carried out to a point where the solution is less than saturated with sodium chloride. Further, co-precipitation of small quantities of sodium chloride in the first stage evaporator 260 may be tolerated.

The concentration of the white liquor in the first stage evaporator 260 involves evaporation typically by boiling, if desired, under a reduced pressure. The water resulting from the evaporation may be recovered in line 262 and utilized to provide part of the overall water requirement of the system.

The evaporation of the white liquor in the first stage evaporator 260 deposits the bulk of the sodium sulphate and sodium carbonate from the white liquor. The salts precipitated from the white liquor in the first stage evaporator 260, i.e. unregenerated pulping chemicals, are removed by line 264 and are returned to the recovery and regeneration zone 230 at a pre-furnacing stage. Preferably, the mixture, in solid or aqueous solution form, is recycled to the black liquor with the sodium sulphate feed in line 240. By recycling these materials in this manner, the sodium, sulphur and carbonate values of the precipitate from the first stage evaporator 260 are recovered and utilized in the system.

The partially concentrated white liquor from the first stage evaporator 260 is passed by line 266 to a second stage crystallizer 268, wherein the white liquor is cooled to precipitate substantially pure sodium chloride therefrom. It is possible to precipitate substantially pure sodium chloride by cooling since under the prevailing conditions the solubility of sodium chloride decreases with decreasing temperature whereas for sodium carbonate and burkeite, the solubility changes only slightly with decreasing temperature relative to the change in solubility of sodium chloride. The sodium chloride precipitated in the second stage crystallizer 268 is removed therefrom by line 270, and is washed to remove entrained liquor.

The sodium chloride recovered in line 270, in the form of solid product from the white liquor concentration and separation zone 258, may be put to a variety of uses, as discussed in more detail above.

In some instances it may be desirable to slightly dilute the partially concentrated white liquor from the first stage evaporator 260 in order to alter the concentration of the sodium carbonate and sodium sulphate therein and thereby facilitate the precipitation of substantial quantities of substantially pure sodium chloride upon cooling. Where such dilution occurs, the cooling may be achieved by flash cooling. Evaporative cooling also may be carried out in the absence of such dilution.

The partially concentrated white liquor from the second stage crystallizer 268 having a reduced sodium chloride content is passed by line 272 to a third stage evaporator 274. While two separate evaporators 260 and 274 and an intermediate crystallizer 268 are illustrated, this manner of illustration is for convenience in describing this emodiment of the invention. Two separate evaporation operations and the intermediate crystallization may be carried out in the same apparatus with separation of solid precipitate from mother liquor after each step. Separate vessels may be employed if desired.

In the third stage evaporator 274, the partially concentrated white liquor fed by line 272 is evaporated to precipitate therefrom further quantities of sodium chloride and unregenerated pulping chemicals. The evaporation of the white liquor in the third stage evaporator 274 may be carried out to precipitate part or substantially all of the precipitatable non-pulping components of the partially concentrated white liquor.

As in the embodiment described above with reference to FIG. 2, the first stage evaporation in evaporator 260 controls the concentration of unregenerated pulping chemicals in the white liquor which is concentrated by the process of the above-mentioned Canadian Pat. No. 915,361 and U.S. Pat. No. 3,746,612 to remove sodium chloride from the white liquor.

By conducting the concentration procedure of Canadian Pat. No. 915,361 and U.S. Pat. No. 3,746,612 in two stages, wherein substantially pure sodium chloride first is precipitated and recovered from the white liquor by cooling the white liquor produced by the first stage evaporation in evaporator 260, and thereafter further quantities of sodium chloride together with the residual amounts of sodium sulphate and sodium carbonate are precipitated and recovered, it is possible to recover substantially pure sodium chloride without the leaching or other separation operation out in the embodiment described above with reference to FIG. 2. This procedure may be an advantageous alternative to the leaching operation under some conditions and the advantages are achieved while simultaneously realizing the advantages arising from use of the preliminary evaporation step to remove the bulk of the sodium carbonate and sodium sulphate values of the white liquor.

In some cases the concentrations of the soluble components of the white liquor resulting from the first stage evaporation may be such that the desired quantity of substantially pure sodium chloride cannot be precipitated by cooling in accordance with this embodiment. In such cases an additional leaching step or other sodium chloride separation procedure, may be carried out on the precipitate recovered in line 278 from the third stage evaporator 274, to recover the remainder of the required amount of sodium chloride.

The water resulting from the evaporation in the third stage evaporator 274 is recovered by line 276 and may be utilized to provide part of the water requirement of the system.

The solid precipitate from the third stage evaporator 274 is removed therefrom by line 278 and is passed to a precipitate dissolver 280. The solid precipitate consists mainly of sodium chloride contaminated with quantities of sodium carbonate and sodium sulphate.

The concentrated white liquor resulting from the third stage evaporator 274 having, in particular, a reduced sodium chloride-content, is passed by line 282 to provide at least part of the pulping liquor fed by line 214 to the digester 212. The concentrated white liquor in line 282 may be diluted with water or BPE, if desired, prior to passage to the digester 212. The water required for the dilution of the concentrated white liquor may be provided at least in part by water recovered in lines 238, 262 and 276.

Therefore, in the white liquor concentration and separation zone 258, the white liquor fed from the recovery and regeneration zone 230 is subjected to concentration in a plurality of steps to provide a white liquor in line 282 having a reduced sodium chloride and unregenerated pulping chemical content. In addition, substantially pure sodium chloride is recovered by line 270 from the materials deposited in the white liquor concentration step and the bulk of the unregenerated pulping chemicals deposited in the white liquor concentration are recycled to a pre-furnacing stage of the recovery and regeneration zone 230 by line 264.

Water is fed to the precipitate dissolver 280 by line 284 to dissolve the sodium chloride, sodium carbonate and sodium sulphate. In accordance with the process of the aforementioned Canadian Pat. No. 915,362 and U.S. Pat. No. 3,740,307, the aqueous solution resulting from the precipitate dissolver 280 in line 286 may be recycled to the green liquor in line 246. The aqueous solution in line 286 may be recycled to the smelt dissolver 242 to combine with the water fed by line 244 to form the green liquor. Alternatively, the aqueous solution in line 286 may be added to a solution of the smelt in water leaving the smelt dissolver 242. In either case, the aqueous solution in line 286 is present in the green liquor fed to the causticizer 248.

In this way, the remainder of the unregenerated pulping chemicals is recycled to the zone 230, at a postfurnacing stage. It is preferred to recycle the aqueous solution in line 286 in this manner in view of the sodium chloride content thereof and the desirability of limiting the quantity of sodium chloride to which the furnace is exposed. The quantity of chemicals present in the recycled aqueous solution 286 under steady state conditions is substantially constant.

In order to maintain a balanced operation in a continuously operating system, it is preferred to remove from the system by line 270, substantially the same amount of sodium chloride as is introduced to the recovery and regeneration zone 230.

Figure 4:
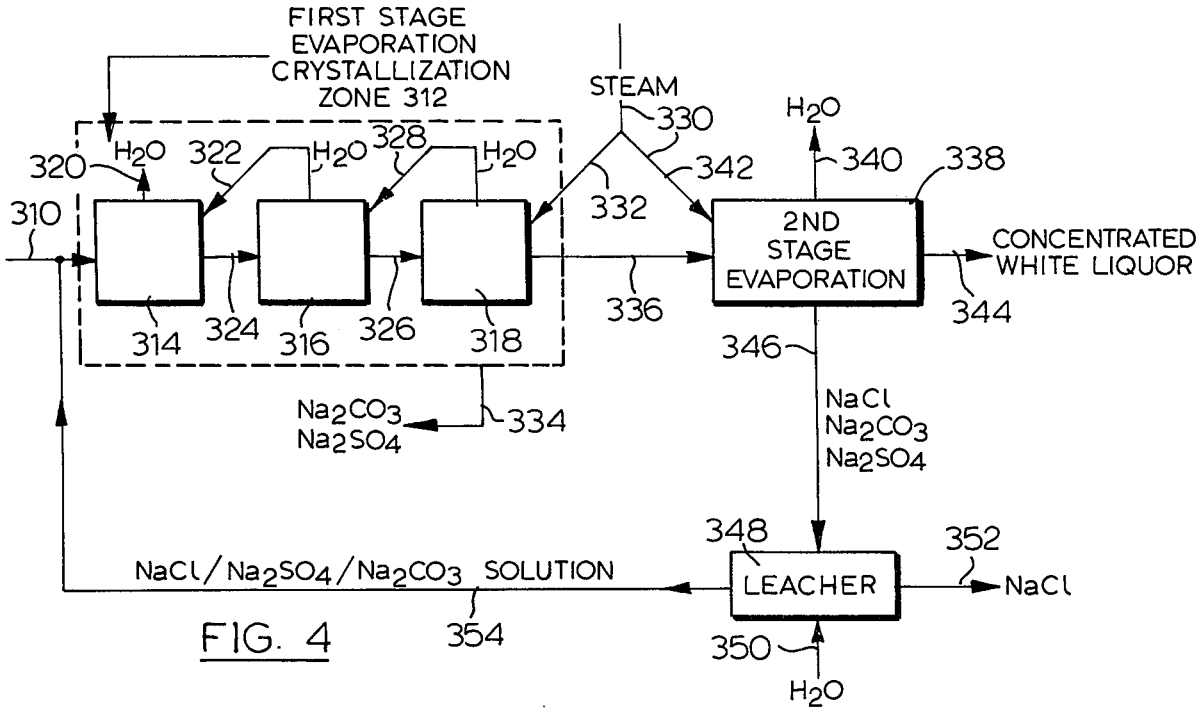
FIG. 4 is a schematic flow sheet of an alternative to a portion of the second embodiment of FIG. 2.

FIG. 4 represents a particular modification of the procedure outlined in FIG. 2. In accordance with the embodiment of FIG. 4, white liquor containing dissolved quantities of sodium chloride and unregenerated pulping chemicals in addition to the active pulping chemicals, sodium sulphide and sodium hydroxide, in a concentration range as specified above with reference to the white liquor in line 156 in FIG. 2, and resulting from a black liquor recovery and regeneration zone, such as zone 130 in FIG. 2, is fed by line 310 to a first stage evaporation-crystallization zone 312, equivalent to the first stage evaporator-crystallizer 160 in FIG. 2.

In the zone 312, the white liquor is evaporated in a plurality of steps at successively increasing temperatures. The steps involve heating in three evaporators 314, 316 and 318, which may be of any convenient construction, such as a triple effect set of evaporators employing backward feed.

In the first evaporator 314, the white liquor subjected to evaporation under a reduced pressure, typically at a temperature of around 125°F, resulting in water vapor which is recovered by line 320. The evaporation temperature in the first evaporator 314 is maintained by heat exchange with water vapor in line 322, which typically has a temperature of around 155°F.

The white liquor then is forwarded by line 324 to the second evaporator 316, typically operating at a temperature of about 180°F under a reduced pressure. The second evaporator 316 may be a forced circulation evaporator-crystallizer with an external horizontal heat exchanger. The water evaporated in the evaporator 316 is passed by line 322 in heat exchange with the first evaporator 314.

The white liquor following evaporation in the evaporator 316 is passed by line 326 to the third evaporator 318, of the same type as evaporator 316, typically operating at a temperature around 255°F. The water vapor resulting from evaporation in the third evaporator 318, typically having a temperature of about 210°F, is passed by line 328 in heat exchange with evaporator 316 to provide the heat requirement thereof.

The heat requirement of the evaporator 318 is provided by steam fed by lines 330 and 332.

In the first stage evaporation-crystallization zone 312, there is deposited from the white liquor, unregenerated pulping chemicals, mainly sodium carbonate and sodium sulphate. The evaporation of the white liquor is carried out in the zone 312 preferably to the point of substantial saturation of the white liquor with sodium chloride, although minor quantities of coprecipitated sodium chloride may be tolerated. Usually, this evaporation proceeds to a dissolved quantity of 26 to 30 weight % $NaOH + Na_2S$. Additionally, the evaporation of the white liquor in the zone 312 may be carried out to a point where the white liquor is undersaturated with respect to sodium chloride.

The unregenerated pulping chemicals deposited in the zone 312, mainly in the second and third evaporators 316 and 318, are removed from the zone 312 by line 334 and are recycled, in solid or aqueous solution form, to a prefurnacing stage as described above with reference to the unregenerated pulping chemicals in line 164 in FIG. 2.

A slurry of the solid material deposited in any evaporator in the first stage evaporation-crystallization zone 312 may be recycled within the particular evaporator to act as a scouring agent and hence reduce the effects of scaling.

The white liquor resulting from the zone 312 is passed by line 336 to a second stage evaporator-crystallizer 338, equivalent to the second stage evaporator-crystallizer 168 in FIG. 2, wherein the white liquor is concentrated by evaporation to deposit a mixture of sodium chloride and residual quantities of sodium carbonate and sodium sulphate. The second stage evaporator-crystallizer 338 may be a forced circulation unit with an external horizontal heat exchanger. The heat exchanger is smaller than those used with the evaporators 316 and 318. The water evaporated in the evaporator-crystallizer 338 is removed by line 340. The condensed water vapor may be used to provide part of the water requirement of the system.

The heat required for the second stage evaporation in the evaporator-crystallizer 338, operating typically at about 167°F, is provided by steam fed by lines 330 and 342.

The concentrated white liquor, after separation of the deposited mixture of sodium chloride, sodium sulphate and sodium carbonate, and having a reduced dissolved sodium chloride content, is recycled by line 344 to the digester, as described above with reference to the concentrated white liquor in line 176 in FIG. 2.

The solid mixture of sodium chloride, sodium sulphate and sodium chloride separated from the concentrated white liquor passes by line 346 to a leacher 348. The solid mixture is leached with water, which may be refrigerated, fed by line 350 to dissolve the sodium carbonate and sodium sulphate content of the solid mixture together with some sodium chloride, leaving a solid mass of substantially pure sodium chloride which is recovered by line 352. Preferably, the quantity of sodium chloride recovered by line 352 is substantially the same as the quantity of sodium chloride introduced to the system.

The solid mixture of sodium chloride, sodium sulphate and sodium carbonate may be subjected to any other convenient procedure to recover substantially pure sodium chloride, such as by hydraulic separation as described above with reference to FIG. 1.

The aqueous solution of sodium sulphate, sodium carbonate and sodium chloride is recycled by line 354 to the white liquor in line 310, or to any stage of the evaporation in the zone 312 prior to the evaporator 318. The quantity of the dissolved components in the recycled solution in line 354 is substantially constant under steady state conditions. Therefore, the sodium chloride content of the solution remains in a closed loop in the white liquid concentration zone.

The sodium carbonate and sodium sulphate values also remain substantially constant due to the precipitation of sodium carbonate and sodium sulphate in the first stage evaporation-crystallization zone 312.

Alternatively, the aqueous solution in line 354 may be forwarded to the green liquor stage, as described above with reference to the aqueous solution in line 182 in FIG. 2.

Figure 5:
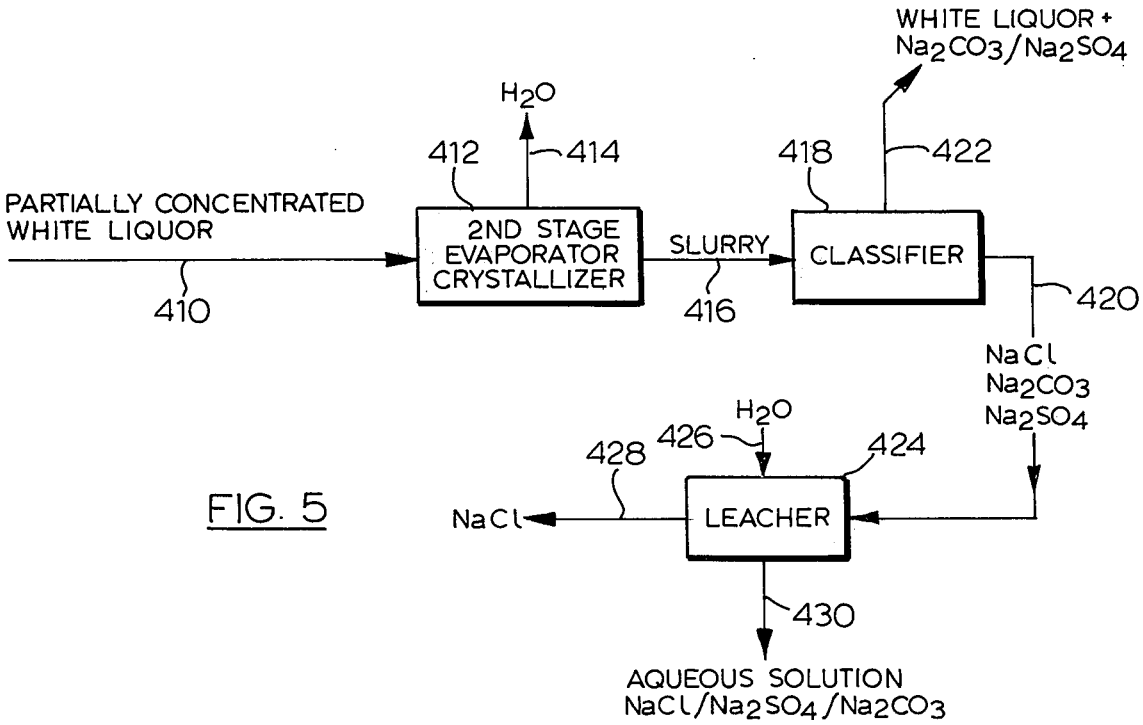
FIG. 5 is a schematic flow sheet of an alternative to a portion of the second embodiment of FIG. 2.

In the accompanying FIG. 5, there is shown an alternative manner of separating substantially pure sodium chloride to that shown in FIG. 2. As seen in FIG. 5, partially concentrated white liquor from a first stage evaporation and crystallization zone, such as in line 166 in FIG. 2 or line 336 in FIG. 4, after separation of precipitated sodium carbonate and sodium sulphate, passes by line 410 to a second stage evaporator-crystallizer 412 wherein the white liquor is evaporated, typically by boiling, under a reduced pressure if desired, the evaporated water being removed by line 414.

The resulting slurry of concentrated white liquor containing solid sodium chloride, sodium carbonate and sulphate is passed by line 416 to a classifier 418 of any convenient construction wherein the sodium chloride crystals are separated substantially from the sodium carbonate and sodium sulphate, althrough small quantities of these may contaminate the separated sodium chloride recovered by line 420. The solid mass in line 420 is centrifuged to separate entrained white liquor which is returned to the classifier 418. The white liquor containing some sulphate and sodium carbonate passes by line 442 to the digester, with appropriate dilution, as required.

The solids in line 420 may be recycled partially to the second stage evaporator-crystallizer 412 in order to increase the sodium chloride crystal size and hence the ease of separation thereof in the classifier 418.

The solid mass in line 420, after centrifuging is passed to a leacher 424 wherein the solid mass is contacted with water fed by line 426 to dissolve the sodium carbonate and sodium sulphate values from the mass together with some of the sodium chloride, leaving substantially pure sodium chloride which is recovered by line 428. The sodium chloride generally is washed to remove entrained liquor therefrom, the latter wash water being recycled to the water in line 426. The aqueous solution of sodium chloride, sodium carbonate and sodium sulphate recovered from the leacher by line 430 may be recycled to the white liquor subjected to the first stage evaporation or to the green liquor.

EXAMPLES

Example 1

Synthetic white liquors were prepared to ascertain the solubilities of sodium chloride, sodium carbonate and sodium sulphate in varying concentration of NaOH+Na 2S both at boiling and 167°F.

Additional synthetic white liquors were prepared to ascertain the solubilities of sodium chloride and sodium carbonate in varying concentration of sodium hydroxide solution, at boiling and at 167°F.

The results are reproduced in the following Table:

TABLE

| wt.% $NaOH+Na_2S$ | wt.% NaOH | wt.% $Na_2S$ | wt.% NaCl | wt.% $Na_2CO_3$ | wt.% $Na_2SO_4$ | temp. °F |
|---|---|---|---|---|---|---|
| 26.09 | 19.76 | 6.33 | 8.40 | 1.56 | 0.42 | Boiling |
| 27.82 | 20.76 | 7.06 | 7.41 | 1.36 | 0.36 | Boiling |
| 29.41 | 22.16 | 7.25 | 6.23 | 1.66 | 0.36 | Boiling |
| 32.63 | 24.69 | 7.94 | 5.83 | 0.91 | 0.32 | Boiling |
| 33.36 | 25.00 | 8.36 | 3.53 | 1.00 | 0.23 | 167° |
| 35.07 | 26.62 | 8.45 | 2.92 | 0.77 | 0.18 | 167° |
| 37.21 | 28.20 | 9.01 | 2.29 | 0.63 | 0.16 | 167° |
| 40.14 | 33.23 | 6.91 | 1.95 | 0.65 | 0.16 | 167° |
| 25.95 | 25.95 | 0 | 8.42 | 1.09 | 0 | Boiling |
| 27.73 | 27.72 | 0 | 8.05 | 1.38 | 0 | Boiling |
| 30.69 | 30.69 | 0 | 6.99 | 0.94 | 0 | Boiling |
| 31.71 | 31.71 | 0 | 6.91 | 1.14 | 0 | Boiling |
| 33.72 | 33.72 | 0 | 3.70 | 0.87 | 0 | 167° |
| 36.05 | 36.05 | 0 | 2.95 | 0.708 | 0 | 167° |
| 38.19 | 38.19 | 0 | 2.96 | 1.01 | 0 | 167° |
| 39.66 | 39.66 | 0 | 2.66 | 1.49 | 0 | 167° |

Example 2

Based on the experimental solubility data of Example 1, the following mass balance was calculated for a system in accordance with the embodiment of FIG. 2, for a typical pulp mill producing 500 tons/day of pulp.

There is provided 166,000 lbs/hr of white liquor in line 156 containing 28,480 lbs/hr of dissolved solids, including 19,050 lbs/hr of $NaOH + Na_2S$, 5,240 lbs/hr of $Na_2CO_3$, 460 lbs/hr of $Na_2SO_4$ and 3,760 lbs/hr of NaCl. 99,620 lbs/hr of water is evaporated from the white liquor at temperatures up to 257°F in a first stage evaporator 160 resulting in deposition of 5,240 lbs/hr of solids, consisting of 4,870 lbs/hr of $Na_2CO_3$ and 370 lbs/hr of $Na_2SO_4$. This solid material after separation from the mother liquor is forwarded in line 264 to a desired location in the mill.

The mother liquor in line 166 resulting from this first stage evaporator at a temperature of about 257°F consisting of 65,600 lbs/hr of liquor having 19,050 lbs/hr of $NaOH + Na_2S$, 920 lbs/hr of $Na_2CO_3$, 250 lbs/hr of $Na_2SO_4$ and 4,460 lbs/hr of NaCl substantially saturating the solution dissolved therein.

8,800 lbs/hr of water is evaporated from the mother liquor in a second stage evaporator 168 while the temperature is cooled to 167°F, resulting in deposition of 3,800 lbs/hr of solid, consisting of 3,090 lbs/hr of NaCl, 550 lbs/hr of $Na_2CO_3$ and 160 lbs/hr of $Na_2SO_4$, and the formation of 53,000 lbs/hr of concentrated white liquor in line 176 containing 20,880 lbs/hr of dissolved solids consisting of 19,050 lbs/hr of $NaOH + Na_2S$, 370 lbs/hr of $Na_2CO_3$, 90 lbs/hr of $Na_2SO_4$ and 1,370 lbs/hr of NaCl.

The deposited solids are separated from the concentrated white liquor and passed by line 172 to a leacher 174 wherein 3,020 lbs/hr of water having a temperature of 68°F is added, resulting in a solid phase consisting of 2,360 lbs/hr of NaCl, equivalent to 104 lbs NaCl/ton of pulp, and 4460 lbs/hr of recycle solution in line 182 containing 1,440 lbs/hr of dissolved solids consisting of 550 lbs/hr of $Na_2CO_3$, 160 lbs/hr of $Na_2SO_4$ and 730 lbs/hr of NaCl.

Example 3

Based on the experimental solubility data of Example 1, the following mass balance was calculated for a 500 ton/day pulp mill in accordance with the embodiment of FIG. 3.

166,000 lbs/hr of white liquor in line 256 contains 28,480 lbs/hr of total dissolved solids, consisting of 19,050 lbs/hr of $NaOH + Na_2S$, 5,240 lbs/hr of $Na_2CO_3$, 460 lbs/hr of $Na_2SO_4$ and 2,520 lbs/hr of NaCl, and is evaporated at temperatures up to 257°F in a first stage evaporator 260. 104,554 lbs/hr of water are evaporated and 5,240 lbs/hr of solid, consisting of 4,870 lbs/hr of $Na_2CO_3$ and 376 lbs/hr of $Na_2SO_4$, are deposited and removed by line 264.

The resulting 59,600 lbs/hr mother liquor having a dissolved solids content of 23,320 lbs/hr, consisting of 19,050 lbs/hr of $NaOH + Na_2S$, 650 lbs/hr of $Na_2CO_3$, 170 lbs/hr of $Na_2SO_4$ and 2,300 lbs/hr of NaCl, substantially saturating the mother liquor, is passed by line 266 to a second stage crystallizer 268 wherein 1,150 lbs/hr of sodium chloride representing 51 lbs/ton of pulp, contaminated by 54 lbs/hr $Na_2CO_3$, are deposited upon cooling of the liquor to 167°F and removed by line 270.

The mother liquor from the second stage crystallizer 268, after removal of the deposited solids, is passed by line 272 to a third stage evaporator 274 wherein 5,364 lbs/hr of water is evaporated therefrom at 167°F, resulting in deposition of 1,236 lbs/hr of solid, consisting of 226 lbs/hr of $Na_2CO_3$, 80 lbs/hr of $Na_2SO_4$ and 930 lbs/hr of NaCl and production of 53,000 lbs/hr of concentrated white liquor in line 282. The deposited solid is made up into an aqueous solution with 3,314 lbs/hr of water for recycle by line 286 to the white liquor in line 256 or the green liquor in line 246.

SUMMARY

Therefore, the present invention is able to achieve concentration of white liquor to remove inert spent bleach plant chemicals therefrom, unregenerated pulping chemicals deposited in the concentration are returned to the spent pulping liquor recovery and regeneration operation and the quantity of inert spent bleach plant chemicals recovered may be controlled at the level of introduction to the recovery and regeneration operation.

The present invention, therefore, may be utilized in an overall pulp mill system to eliminate bleach plant effluents while at the same time operating sufficiently. The steps involved in the realization of an "effluent-free" pulp mill, made practical by the present invention, are: use of bleach plant effluent to wash the brown stock; use of complete countercurrent washing in the bleach plant to decrease the volume of effluent; substitute chlorine dioxide for chlorine in the chlorination on stage of the CEDED bleaching sequence to allow countercurrent washing while maintaining quality in bleached pulp; use of white liquor concentration to recover sodium chloride from the chemical recovery cycle and to limit the concentration of sodium chloride throughout the cycle; and the use of black and white liquor evaporator condensates, suitably cleaned, to wash the bleached pulp.

Modifications are possible within the scope of the invention.

What I claim is:

1. A process of pulping cellulosic fibrous material including the steps of contacting said cellulosic fibrous material with a pulping liquor containing sodium hydroxide as an active pulping chemical, separating pulped material from spent pulping liquor, subjecting said spent pulping liquor to recovery and regeneration steps to provide a white liquor containing dissolved quantities of sodium hydroxide and unregenerated pulping chemicals including sodium carbonate and sodium sulphate, said white liquor also containing sodium chloride introduced to said recovery and regeneration steps, evaporating at least part of said white liquor to deposit therefrom (*a*) sodium chloride and (*b*) sodium carbonate and sodium sulphate constituting at least part of said unregenerated pulping chemicals, recovering at least part of the deposited sodium carbonate and sodium sulphate substantially free from sodium chloride from the deposited materials, forwarding at least part of said recovered substantially sodium chloride-free sodium carbonate and sodium sulphate to said spent pulping liquor, and separating and recovering sodium chloride from the deposited materials.

2. A process of pulping cellulosic fibrous material including the steps of contacting said cellulosic fibrous material with a pulping liquor containing sodium hydroxide as an active pulping chemical, separating pulped material from spent pulping liquor, subjecting said spent pulping liquor to recovery and regeneration steps to provide a white liquor containing dissolved quantities of sodium hydroxide and unregenerated pulping chemicals including sodium carbonate and sodium sulphate, said white liquor also containing sodium chloride introduced to said recovery and regeneration steps, evaporating said white liquor to substantially the saturation of the white liquor with sodium chloride while depositing therefrom sodium carbonate and sodium sulphate substantially free from sodium chloride and constituting at least part of said unregenerated pulping chemicals, separating said deposited sodium carbonate and sodium sulphate from the evaporated white liquor, forwarding at least part of said separated sodium carbonate and sodium sulphate to said spent pulping liquor, further evaporating the evaporated white liquor after said separation of said deposited sodium carbonate and sodium sulphate therefrom to deposit sodium chloride therefrom, and separating said deposited sodium chloride from the resulting concentrated white liquor.

3. The process of claim 2 wherein said pulping liquor contains sodium sulphide in addition to sodium hydroxide as an active pulping chemical.

4. The process of claim 2 wherein said pulping liquor contains sodium sulphide in addition to sodium hydroxide as an active pulping chemical, said sodium chloride is introduced to said recovery and regeneration steps by introduction to said spent pulping liquor and said recovery and regeneration steps include forming a smelt containing sodium sulphide, sodium carbonate, sodium chloride and sodium sulphate from said spent pulping liquor, forming from said smelt an aqueous solution of sodium sulphide and solid residue containing sodium carbonate, sodium chloride and sodium sulphate, forming a sulphide-lean green liquor from said residue, causticizing said green liquor thereby forming a sulphide-lean white liquor containing sodium hydroxide and dissolved quantities of sodium chloride, sodium sulphate and uncausticized sodium carbonate, said latter two materials constituting said unregenerated pulping chemicals, said sulphide-lean white liquor being said white liquor subjected to evaporation, and including combining the concentrated white liquor after separation therefrom of said deposited materials with at least part of said aqueous solution of sodium sulphide, and recycling at least part of the resulting white liquor as at least part of said pulping liquor.

5. A process of pulping cellulosic fibrous material including the steps of contacting said cellulosic fibrous material with a pulping liquor containing sodium hydroxide as an active pulping chemical, separating pulped material from spent pulping liquor, subjecting said spent pulping liquor to recovery and regeneration steps to provide a white liquor containing dissolved quantities of sodium hydroxide and unregenerated pulping chemicals including sodium carbonate and sodium sulphate, said white liquor also containing sodium chloride introduced to said recovery and regeneration steps, evaporating said white liquor to substantially the saturation of the white liquor with sodium chloride while depositing therefrom sodium carbonate and sodium sulphate substantially free from sodium chloride and constituting at least part of said unregenerated pulping chemicals, separating said deposited sodium carbonate and sodium sulphate from the evaporated white liquor, forwarding at least part of said separated sodium carbonate and sodium sulphate to said spent pulping liquor, cooling said evaporated white liquor after separation of said deposited sodium carbonate and sodium sulphate therefrom to deposit substantially pure sodium chloride, and removing said deposited sodium chloride from the resulting concentrated white liquor.

6. The process of claim 5 wherein said pulping liquor contains sodium sulphide in addition to sodium hydroxide as an active pulping chemical.

7. The process of claim 5 including evaporating the concentrated white liquor resulting from the removal of deposited sodium chloride therefrom to deposit a mixture of sodium chloride and unregenerated pulping chemicals and recovering said mixture from the resulting concentrated white liquor.

8. The process of claim 5 wherein said pulping liquor contains sodium sulphide in addition to sodium hydroxide as an active pulping chemical, said sodium chloride is introduced to said recovery and regeneration steps by introduction to said spent pulping liquor and said recovery and regeneration steps include forming a smelt containing sodium sulphide, sodium carbonate, sodium chloride and sodium sulphate from said spent pulping liquor, forming from said smelt an aqueous solution of sodium sulphide and a solid residue containing sodium carbonate, sodium chloride and sodium sulphate, forming a sulphide-lean green liquor from said residue, causticizing said green liquor thereby forming a sulphide-lean white liquor containing sodium hydroxide and dissolved quantities of sodium chloride, sodium sulphate and causticized sodium carbonate, said latter two materials constituting said unregenerated pulping chemicals, said sulphide-lean white liquor being said white liquor subjected to evaporation, and including combining the concentrated white liquor after separation therefrom of said deposited materials with at least part of said aqueous solution of sodium sulphide, and recycling at least part of the resulting white liquor as at least part of said pulping liquor.

9. The process of claim 1 wherein evaporation of said white liquor is carried out by evaporating said white liquor to deposit therefrom a mixture of (*a*) sodium chloride and (*b*) sodium carbonate and sodium sulphate constituting at least part of said unregenerated pulping chemicals as said deposited materials, separating substantially pure sodium chloride from said deposited mixture as said sodium chloride separated and recovered from the deposited materials by a physical classification of crystal sizes of the components of said mixture, thereby leaving sodium carbonate and sodium sulphate as said recovered sodium carbonate and sodium sulphate substantially free from sodium chloride.

10. The process of claim 9 wherein said pulping liquor contains sodium sulphide in addition to sodium hydroxide as an active pulping chemical.

11. The process of claim 9 wherein said pulping liquor contains sodium hydroxide as the sole active pulping chemical.

12. The process of claim 9 wherein said pulping liquor contains sodium sulphide in addition to sodium hydroxide as an active pulping chemical, said sodium chloride is introduced to said recovery and regeneration steps by introduction to said spent pulping liquor and said recovery and regeneration steps include forming a smelt containing sodium sulphide, sodium carbonate, sodium chloride and sodium sulphate from said spent pulping liquor, forming from said smelt an aqueous solution of sodium sulphide and a solid residue containing sodium carbonate, sodium chloride and sodium sulphate, forming a sulphide-lean green liquor from said residue, causticizing said green liquor thereby forming a sulphide-lean white liquor containing sodium hydroxide and dissolved quantities of sodium chloride, sodium sulphate and uncausticized sodium carbonate, said latter two materials constituting said unregenerated pulping chemicals, said sulphide-lean white liquor being said white liquor subjected to evaporation and including combining the concentrated white liquor after separation therefrom of said deposited materials with at least part of said aqueous solution of sodium sulphide, and recycling at least part of the resulting white liquor as at least part of said pulping liquor.

13. The process of claim 1 including utilizing the concentrated white liquor after separation therefrom of said deposited materials as at least part of said pulping liquor.

14. The process of claim 1 wherein said pulping liquor contains sodium sulphide in addition to sodium hydroxide as an active pulping chemical, said sodium chloride is introduced to said recovery and regeneration steps by introduction to said spent pulping liquor and said recovery and regeneration steps include evaporating said spent pulping liquor, forming a smelt containing sodium sulphide, sodium carbonate, sodium chloride and sodium sulphate from said evaporated spent pulping liquor, dissolving said smelt in an aqueous medium to provide a green liquor and causticizing said green liquor thereby forming said white liquor containing sodium hydroxide and sodium sulphide as the active pulping chemicals, sodium chloride, and sodium sulphate and uncausticized sodium carbonate, the latter two materials constituting said unregenerated pulping chemicals.

15. A pulp mill process including digesting cellulosic fibrous material with a pulping liquor containing sodium hydroxide as an active pulping chemical, separating the soformed pulp from spent pulping liquor, subjecting said spent pulping liquor to a series of recovery and regeneration steps to provide a white liquor containing dissolved quantities of sodium hydroxide and unregenerated pulping chemicals including sodium carbonate and sodium sulphate, subjecting said pulp to a series of bleaching and purification steps using at least one chlorine-containing bleaching chemical in at least one of said bleaching steps and aqueous sodium hydroxide-containing solutions in said purification steps, discharging a sodium chloride-containing aqueous effluent from said series of bleaching and purification steps into said spent pulping liquor, whereby said white liquor also contains dissolved quantities of sodium chloride, evaporating the white liquor to deposit therefrom (*a*) sodium chloride and (*b*) sodium carbonate and sodium sulphate constituting at least part of said unregenerated pulping chemicals, recycling said evaporated white liquor to said digesting step as at least part of said pulping liquor, separating substantially pure sodium chloride from the material deposited in the evaporation of said white liquor and forwarding at least part of said deposited sodium carbonate and sodium sulphate substantially free from sodium chloride to said spent pulping liquor.

16. The process of claim 15 wherein at least part of said deposited sodium carbonate and sodium sulphate is forwarded directly to said spent pulping liquor.

17. The process of claim 15 wherein at least part of said deposited sodium carbonate and sodium sulphate is forwarded to said pulping liquor, whereby said at least part is present in the spent pulping liquor.

18. The process of claim 15 wherein said digesting of cellulosic fibrous material is carried out using a pulping liquor containing sodium sulphide in addition to sodium hydroxide as the active pulping chemicals, and said series of recovery and regeneration steps includes the steps of concentrating the spent pulping liquor, providing make up quantities of a sodium- and sulphur-containing compound in said concentrated spent pulping liquor, furnacing said concentrated spent pulping liquor to form a smelt, dissolving said smelt in water and causticizing the resulting aqueous solution to provide a white liquor containing sodium hydroxide and sodium sulphide and dissolved quantities of sodium chloride and said unregenerated pulping chemicals.

19. A pulp mill process including digesting cellulosic fibrous material with a pulping liquor containing sodium sulphide and sodium hydroxide as the active pulping chemicals, separating the so-formed pulp from spent pulping liquor, subjecting said pulp to a series of bleaching and purification steps using at least one chlorine-containing bleaching chemical in at least one of said bleaching steps and aqueous sodium hydroxide-containing solution in said purification steps, discharging a sodium chloride-containing aqueous effluent from said bleaching and purification steps into said spent pulping liquor, subjecting said spent pulping liquor to a series of recovery and regeneration steps including concentrating the spent pulping liquor, providing make-up quantities of a sodium- and sulphur-containing compound in said concentrated spent liquor, furnacing said concentrated spent liquor to form a smelt, dissolving said smelt in water and causticizing the resulting aqueous solution to provide a white liquor containing sodium hydroxide and sodium sulphide and dissolved quantities of unregenerated pulping chemicals including sodium carbonate and sodium sulphate, evaporating said white liquor to substantially the saturation of the white liquor with sodium chloride while depositing therefrom sodium carbonate and sodium sulphate substantially free from sodium chloride and constituting at least part of said unregenerated pulping chemicals, separating said deposited sodium carbonate and sodium sulphate from the evaporated white liquor, forwarding at least part of said separated sodium carbonate and sodium sulphate to said concentrated spent liquor, further evaporating the evaporated white liquor to deposit therefrom a mixture of sodium chloride, sodium carbonate and sodium sulphate, and separating said deposited mixture of sodium chloride, sodium carbonate and sodium sulphate from the resulting concentrated white liquor.

20. The process of claim 19 wherein said separated sodium carbonate and sodium sulphate is added to said pulping liquor used to digest said cellulosic fibrous material, whereby said separated sodium carbonate and sodium sulphate is forwarded to the concentrated spent pulping liquor.

21. The process of claim 19 wherein said separated sodium carbonate and sodium sulphate is added directly to said spent pulping liquor.

22. The process of claim 19 wherein part of said separated sodium carbonate and sodium sulphate is introduced to said spent pulping liquor as part of said make-up chemicals and the remainder of said separated sodium carbonate and sodium sulphate is introduced to said aqueous solution resulting from dissolving said smelt.

23. The process of claim 19 wherein said separated mixture of sodium chloride, sodium sulphate and sodium carbonate is treated to recover substantially pure sodium chloride therefrom.

24. The process of claim 23 wherein said substantially pure sodium chloride is recovered from the latter separated mixture by physical classification of crystal sizes of the components.

25. The process of claim 23 wherein said substantially pure sodium chloride is recovered from said latter mixture by leaching said latter mixture with water to form an aqueous solution of sodium carbonate, sodium sulphate and sodium chloride and leave a solid mass consisting of substantially pure sodium chloride.

26. The process of claim 25 including recycling said latter aqueous solution to said white liquor prior to said evaporation thereof or during said evaporation thereof to the saturation of the white liquor with sodium chloride, whereby said deposition, separation and forwarding of said sodium carbonate and sodium sulphate with consequent reduction of at least part of said forwarded sodium sulphate in said furnacing step prevent the undue build up of sodium sulphate in said white liquor by the recycle of said latter aqueous solution.

27. The process of claim 25 including recycling said latter aqueous solution to the aqueous solution resulting from dissolving said smelt, whereby said deposition, separation and forwarding of said sodium carbonate and sodium sulphate with consequent reduction of at least part of said forwarded sodium sulphate in said furnacing step prevent the undue build up of sodium sulphate in said white liquor by the recycle of said latter aqueous solution.

28. The process of claim 19 wherein said evaporation is carried out by boiling said white liquor.

29. The process of claim 19 wherein said evaporation is carried out by boiling said white liquor under a reduced pressure.

30. A pulp mill process including digesting cellulosic fibrous material with a pulping liquor containing sodium sulphide and sodium hydroxide as the active pulping chemicals, separating the so-formed pulp from spent pulping liquor, subjecting said pulp to a series of bleaching and purification steps using at least one chlorine-containing bleaching chemical in at least one of said bleaching steps and aqueous sodium hydroxide-containing solution in said purification steps, discharging a sodium chloride-containing aqueous effluent from said bleaching and purification steps into said spent pulping liquor, subjecting said spent pulping liquor to a series of recovery and regeneration steps including concentrating the spent pulping liquor, providing make-up quantities of a sodium- and sulphur-containing compound in said concentrated spent liquor, furnacing said concentrated spent liquor to form a smelt, dissolving said smelt in water and causticizing the resulting aqueous solution to provide a white liquor containing sodium hydroxide and sodium sulphide and dissolved quantities of unregenerated pulping chemicals including sodium carbonate and sodium sulphate, evaporating said white liquor to substantially the saturation of the pulping liquor with sodium chloride while depositing therefrom sodium carbonate and sodium sulphate substantially free from sodium chloride and constituting at least part of said unregenerated pulping chemicals, separating said deposited sodium carbonate and sodium sulphate from said evaporated white liquor, forwarding at least part of said separated sodium carbonate and sodium sulphate to said concentrated spent pulping liquor, cooling said evaporated white liquor to deposit therefrom substantially pure sodium chloride, and recovering said substantially pure sodium chloride from said cooled white liquor.

31. The process of claim 30 wherein said separated sodium carbonate and sodium sulphate is added to said pulping liquor used to digest said cellulosic fibrous material, whereby said separated sodium carbonate and sodium sulphate is forwarded to the concentrated spent pulping liquor.

32. The process of claim 30 wherein part of said separated sodium carbonate and sodium sulphate is introduced to said concentrated spent pulping liquor as part of said make up chemicals, the remainder of said separated sodium carbonate and sodium sulphate is introduced to said aqueous solution resulting from dissolving said smelt.

33. The process of claim 30 wherein said make up quantities of sodium- and sulphur-containing compound are added to said concentrated spent pulping liquor and said separated sodium carbonate and sodium sulphate is utilized as part of said make up chemicals.

34. The process of claim 30 including evaporating the white liquor resulting from the recovery of said sodium chloride to deposit a mixture of sodium chloride, sodium carbonate and sodium sulphate, and recovering said mixture of sodium chloride, sodium carbonate and sodium sulphate from the latter concentrated white liquor.

35. The process of claim 34 wherein said recovered mixture of sodium chloride, sodium carbonate and sodium sulphate is formed into an aqueous solution.

36. The process of claim 35 including recycling said latter aqueous solution to said white liquor prior to said evaporation thereof or during said evaporation thereof to the saturation of the white liquor with sodium chloride, whereby said deposition, separation and forwarding of said sodium carbonate and sodium sulphate with consequent reduction of at least part of said forwarded sodium sulphate in said furnacing step prevent the undue build up of sodium sulphate in said white liquor by the recycle of said latter aqueous solution.

37. The process of claim 35 including recycling said latter aqueous solution to the aqueous solution resulting from dissolving said smelt, whereby said deposition, separation and forwarding of said sodium carbonate and sodium sulphate with consequent reduction of at least part of said forwarded sodium sulphate in said furnacing step prevent the undue build up of sodium sulphate in said white liquor by the recycle of said latter aqueous solution.

38. The process of claim 30 wherein said cooling is carried out by flash cooling.

39. The process of claim 30 wherein said evaporation is carried out by boiling said white liquor.

40. The process of claim 30 wherein said evaporation is carried out by boiling said white liquor under a reduced pressure.

41. The process of claim 15 including washing said pulp after formation thereof and before passage to said series of bleaching and purification steps and utilizing said sodium chloride-containing aqueous effluent in said washing.

42. The process of claim 15 wherein said series of bleaching and purification steps involves a first stage bleaching with chlorine, chlorine dioxide or a mixture thereof, a first stage caustic extraction using sodium hydroxide solution, a second stage bleaching with chlorine dioxide, a second stage caustic extraction using sodium hydroxide solution and a third stage bleaching with chlorine dioxide, the quantity of sodium hydroxide used being equivalent to the quantity of chlorine used in said bleaching steps, the spent bleaching and caustic extraction liquors being mixed to provide a sodium chloride containing aqueous effluent of substantially neutral pH.

43. The process of claim 42 including separating said pulp and spent pulping liquor while washing said pulp after formation thereof and before passage to said series of bleaching and purification operations, washing said pulp after each said bleaching and caustic extraction, the wash water utilized in said latter washing passing countercurrently to the pulp through said series of bleaching and purification steps, mixing the spent wash water from the latter washing with the spent bleaching and caustic extraction chemicals to provide the sodium chloride containing aqueous effluent and utilizing said latter effluent in said washing of said pulp prior to passage to said series of bleaching and purification steps, whereby said latter effluent is introduced into said spent pulping liquor.

* * * * *

UNITED STATES PATENT OFFICE

CERTIFICATE OF CORRECTION

Patent No. 3,950,217 Dated April 13, 1976

Inventor(s) Douglas W. Reeve

It is certified that error appears in the above-identified patent and that said Letters Patent are hereby corrected as shown below:

Column 24, line 58, after "Fig. 2" insert "modified to provide recycle line 182 to white liquor inlet line 156 instead of to the green liquor in line 146";

Column 24, line 63, change "3760" to read "3730";

Column 25, line 33, after "Fig. 3" insert "modified to provide recycle line 286 to white liquor inlet line 256 instead of to the green liquor in line 246";

Column 25, line 41, change "376" to "370";

Column 25, line 46, change "2300" to "3450";

Column 25, line 62, delete "or the green liquor in line 246".

Signed and Sealed this

*Seventeenth* Day of *October 1978*

[SEAL]

*Attest:*

RUTH C. MASON
*Attesting Officer*

DONALD W. BANNER
*Commissioner of Patents and Trademarks*